US005992959A

United States Patent [19]

Kawamoto

[11] Patent Number: 5,992,959

[45] Date of Patent: Nov. 30, 1999

[54] DRAWER BOX

[75] Inventor: Shinsuke Kawamoto, Ikoma-gun, Japan

[73] Assignee: Sharp Kabushiki Kaisha, Osaka, Japan

[21] Appl. No.: 09/021,156

[22] Filed: Feb. 10, 1998

[30] Foreign Application Priority Data

Feb. 13, 1997 [JP] Japan ..... 9-029423

[51] Int. Cl.[6] ..... A47B 88/00

[52] U.S. Cl. ..... 312/348.3; 312/304

[58] Field of Search ..... 235/22; 312/193, 312/291, 301, 304, 305, 327, 348.3; 220/529, 533

[56] References Cited

U.S. PATENT DOCUMENTS

| | | | |
|---|---|---|---|
| 1,754,911 | 4/1930 | Sherwood et al. | 312/327 X |
| 2,268,637 | 1/1942 | Bernstein | 312/348.3 X |
| 4,595,246 | 6/1986 | Bross . | |

FOREIGN PATENT DOCUMENTS

| | | |
|---|---|---|
| 0 157 313 | 10/1985 | European Pat. Off. . |
| 0 560 301 | 9/1993 | European Pat. Off. . |
| 2 618 994 | 2/1989 | France . |
| 2-137089 | 5/1990 | Japan . |
| 3-80395 | 4/1991 | Japan . |
| 4-352298 | 12/1992 | Japan . |
| 6-15178 | 2/1994 | Japan . |
| 6-30883 | 4/1994 | Japan . |
| 696 424 | 9/1953 | United Kingdom . |

*Primary Examiner*—Peter M. Cuomo
*Assistant Examiner*—Karlena D. Schwing
*Attorney, Agent, or Firm*—Dike, Bronstein, Roberts & Cushman, LLP; David G. Conlin

[57] ABSTRACT

A drawer box, including: a plurality of note accommodation parts arranged in a width direction of the drawer box, at least one note accommodation part being deep-bottomed with a depth substantially equal to a height of the drawer box; a divider including a bottom plate for dividing the at least one deep-bottomed note accommodation part into an upper portion and a lower portion, the divider further including an upright portion which extends perpendicularly from one end of the bottom plate; a first holding device for holding the divider in a position where the bottom plate divides the at least one deep-bottomed note accommodation part into the upper portion and the lower portion; a guide device for guiding the divider to a bottom position, wherein the divider divides the at least one deep-bottomed note accommodation part into two side portions by the upright portion of the divider; and a second holding device for holding the divider in the bottom position.

7 Claims, 20 Drawing Sheets

DRAWER BOX

BACKGROUND OF THE INVENTION

1. FIELD OF THE INVENTION

The present invention relates to a drawer box which is included in an electronic money register, a POS terminal, and the like for accommodating coins and notes, and papers such as checks and gift tokens.

2. DESCRIPTION OF THE RELATED ART

A drawer box for accommodating money in an electronic money register, a POS terminal, and the like, is usually structured to include a resin-molded money case provided in a main body of the drawer-type box. FIG. 20 illustrates an exemplary conventional money case.

The money case includes a plurality of coin accommodation portions 1 in a front part thereof, and a plurality of note accommodation portions 2 for horizontally accommodating notes in a stacked manner which are posterior to the coin accommodation portions 1. The note accommodation portions 2 are arranged side by side along a width direction (arrow W) of the money case. Often, the coin accommodation portions 1 have a deep-bottomed shape having a depth substantially equal to the height of the money case, while the note accommodation portions 2 have a shallow-bottomed shape having a depth substantially half of the height of the money case. The note accommodation portions 2 have a shallow-bottomed shape, for example, for the following reasons: an increased depth makes it difficult to take out notes; and a lock unit needs to be provided below the note accommodation portions 2 in order to hold the drawer box in an open or closed state.

A larger note accommodation space is demanded in order to cope with an increase in the numbers of notes caused by issuance of new kinds of high-value notes in overseas countries, and to deal with countries in which many kinds of notes are circulated. However, space-saving is also strongly demanded, which makes it difficult to simply increase the size of the drawer box in order to enlarge the note accommodation space. Therefore, enlargement of the note accommodation space while avoiding an increase in the size of the drawer box has been strongly demanded.

Drawer boxes proposed to cope with such a demand are disclosed, for example, in Japanese Laid-Open Utility Model Publication No. 6-30883, Japanese Laid-Open Utility Model Publication No. 6-15178, Japanese Laid-Open Publication No. 4-352298, Japanese Laid-Open Publication No. 3-80395, and Japanese Laid-Open Publication No. 2-137089.

The drawer box disclosed in Japanese Laid-Open Publication No. 4-352298 adopts a structure in which a note accommodation part has a deep-bottomed shape and is divided into an upper and a lower portions by a detachable divider. This structure allows the portion above the divider to be used as a note accommodation portion with a shallow bottom in which notes are accommodated horizontally, and also allows the portion below the divider to accommodate notes in the case where there are many kinds of notes. Therefore, the note accommodation space is enlarged while avoiding an increase in the size of the drawer box.

However, in the case where the portion below the divider is used, the notes accommodated in the portion above the divider need to be taken out and put back together with the divider every time notes are taken out of and put into the portion below the divider. This is time-consuming and troublesome.

Furthermore, since the notes accommodated below the divider cannot be visibly checked without removing the divider, the recognition of the notes is not easily performed.

SUMMARY OF THE INVENTION

According to one aspect of the invention, a drawer box includes: a plurality of note accommodation parts arranged in a width direction of the drawer box, at least one note accommodation part being deep-bottomed with a depth substantially equal to a height of the drawer box; a divider including a bottom plate for dividing the at least one deep-bottomed note accommodation part into an upper portion and a lower portion, the divider further including an upright portion which extends perpendicularly from one end of the bottom plate; a first holding device for holding the divider in a position where the bottom plate divides the at least one deep-bottomed note accommodation part into the upper portion and the lower portion; a guide device for guiding the divider to a bottom position, wherein the divider divides the at least one deep-bottomed note accommodation part into two side portions by the upright portion of the divider; and a second holding device for holding the divider in the bottom position.

In one embodiment of the invention, the at least one deep-bottomed note accommodation part including the divider is provided on one side of the drawer box.

In one embodiment of the invention, the at least one deep-bottomed note accommodation part including the divider is provided on each of two sides of the drawer box.

In one embodiment of the invention, a note accommodation part other than the at least one deep-bottomed note accommodation part has a shallow-bottomed shape, and a lock unit for maintaining the drawer box in an opened or closed state is provided under the note accommodation part having the shallow-bottomed shape.

In one embodiment of the invention, the note accommodation part having the shallow-bottomed shape horizontally accommodates notes in a stacked manner.

According to one aspect of the invention, a drawer box includes: a plurality of note accommodation parts arranged in a width direction of the drawer box, at least one note accommodation part being deep-bottomed with a depth substantially equal to a height of the drawer box; a divider for dividing the at least one deep-bottomed note accommodation part into an upper portion and a lower portion; a supporting device for supporting the divider within the at least one deep-bottomed note accommodation part, wherein the supporting device is pivotal about an axis existing on the divider; a first holding device for holding the divider in a substantially horizontal position for dividing the at least one deep-bottomed note accommodation part into the upper portion and the lower portion; and a second holding device for holding the divider in a substantially perpendicular position for dividing the at least one deep-bottomed note accommodation part into two side portions.

In one embodiment of the invention, the at least one deep-bottomed note accommodation part including the divider is provided on one side of the drawer box.

In one embodiment of the invention, the at least one deep-bottomed note accommodation part including the divider is provided on each of two sides of the drawer box.

In one embodiment of the invention, a note accommodation part other than the at least one deep-bottomed note accommodation part has a shallow-bottomed shape, and a lock unit for maintaining the drawer box in an opened or closed state is provided under the note accommodation part having the shallow-bottomed shape.

In one embodiment of the invention, the note accommodation part having the shallow-bottomed shape horizontally accommodates notes in a stacked manner.

In one embodiment of the invention, all of the plurality of note accommodation parts have a deep-bottomed shape and include the divider.

According to one aspect of the invention, a drawer box includes: a plurality of note accommodation parts arranged in a width direction of the drawer box, at least one note accommodation part being deep-bottomed with a depth substantially equal to a height of the drawer box; a divider for dividing the at least one deep-bottomed note accommodation part into an upper portion and a lower portion; a first holding device for detachably holding the divider in a position of dividing the at least one deep-bottomed note accommodation part into the upper portion and the lower portion; and a second holding device for detachably holding the divider in a position of dividing the at least one deep-bottomed note accommodation part into two side portions.

In one embodiment of the invention, the at least one deep-bottomed note accommodation part including the divider is provided on one side of the drawer box.

In one embodiment of the invention, the at least one deep-bottomed note accommodation part including the divider is provided on each of two sides of the drawer box.

In one embodiment of the invention, a note accommodation part other than the at least one deep-bottomed note accommodation part has a shallow-bottomed shape, and a lock unit for maintaining the drawer box in an opened or closed state is provided under the note accommodation part having the shallow-bottomed shape.

In one embodiment of the invention, the note accommodation part having the shallow-bottomed shape horizontally accommodates notes in a stacked manner.

In one embodiment of the invention, all of the plurality of note accommodation parts have a deep-bottomed shape and include the divider.

According to one aspect of the invention, a drawer box includes: a plurality of coin accommodation parts provided in the drawer box; a divider detachably provided in the drawer box for dividing at least one of the plurality of coin accommodation parts into at least two coin accommodation portions; a first holding device for detachably holding the divider in a position of dividing the at least one coin accommodation part into at least two coin accommodation portions; and a second holding device for pivotally hinging the divider to a top edge of a wall of the at least one coin accommodation part about a horizontal axis.

In one embodiment of the invention, a drawer box further includes a locking device for locking a free end of the divider to a wall portion opposing to the wall portion to which the divider is hinged when the divider is hinged.

In one embodiment of the invention, a total size of the two adjacent coin accommodation portions is sufficient to accommodate notes.

In one embodiment of the invention, the guide device obliquely guides the divider to a bottom position, wherein the divider divides the at least one deep-bottomed note accommodation part into two side portions by the upright portion of the divider.

Thus, the invention described herein makes possible the advantages of providing (1) a drawer box for enlarging a note accommodation space while avoiding an increase in the size of the drawer box; and (2) a drawer box for facilitating the deposit and retrieval of notes and the recognition of notes in an enlarged note accommodation space.

These and other advantages of the present invention will become apparent to those skilled in the art upon reading and understanding the following detailed description with reference to the accompanying figures.

DESCRIPTION OF THE PREFERRED EMBODIMENTS

The present invention will be described below by way of illustrative examples with reference to the accompanying drawings.

EXAMPLE 1

Figure 1:
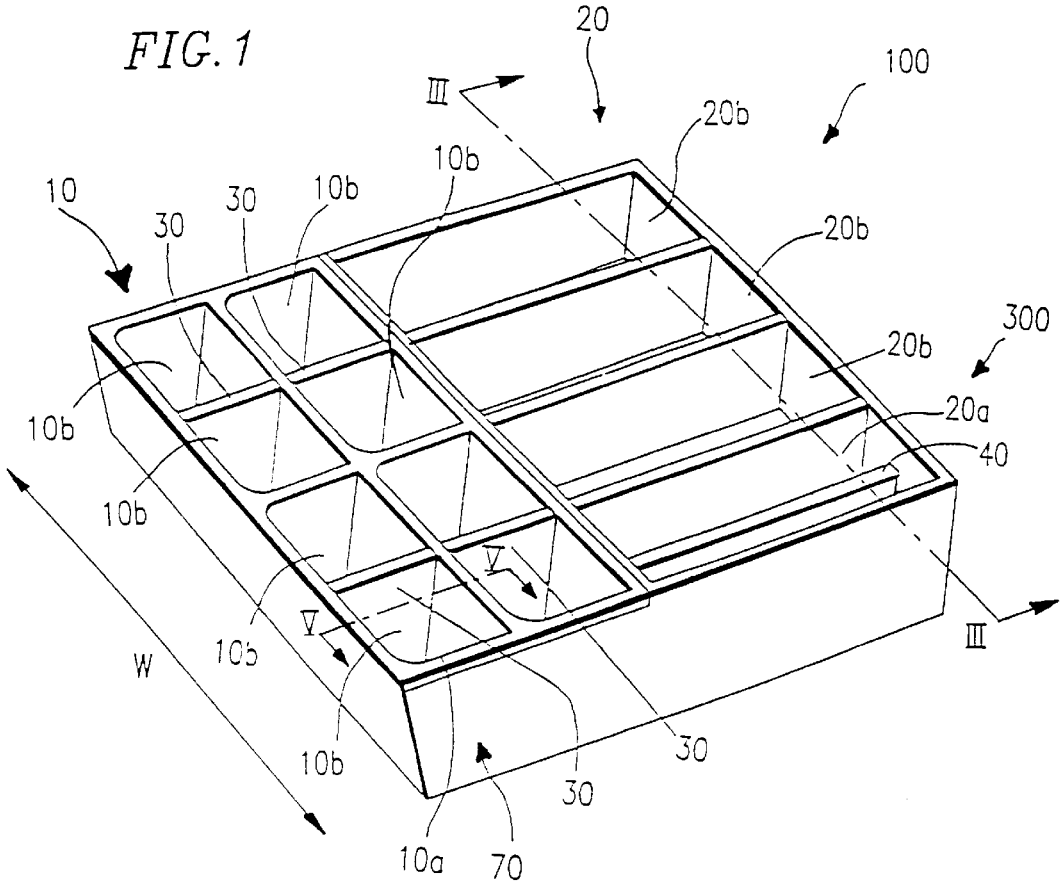
FIG. 1 is a perspective view of a drawer box including a money case in Example 1 according to the present invention.
Figure 2:
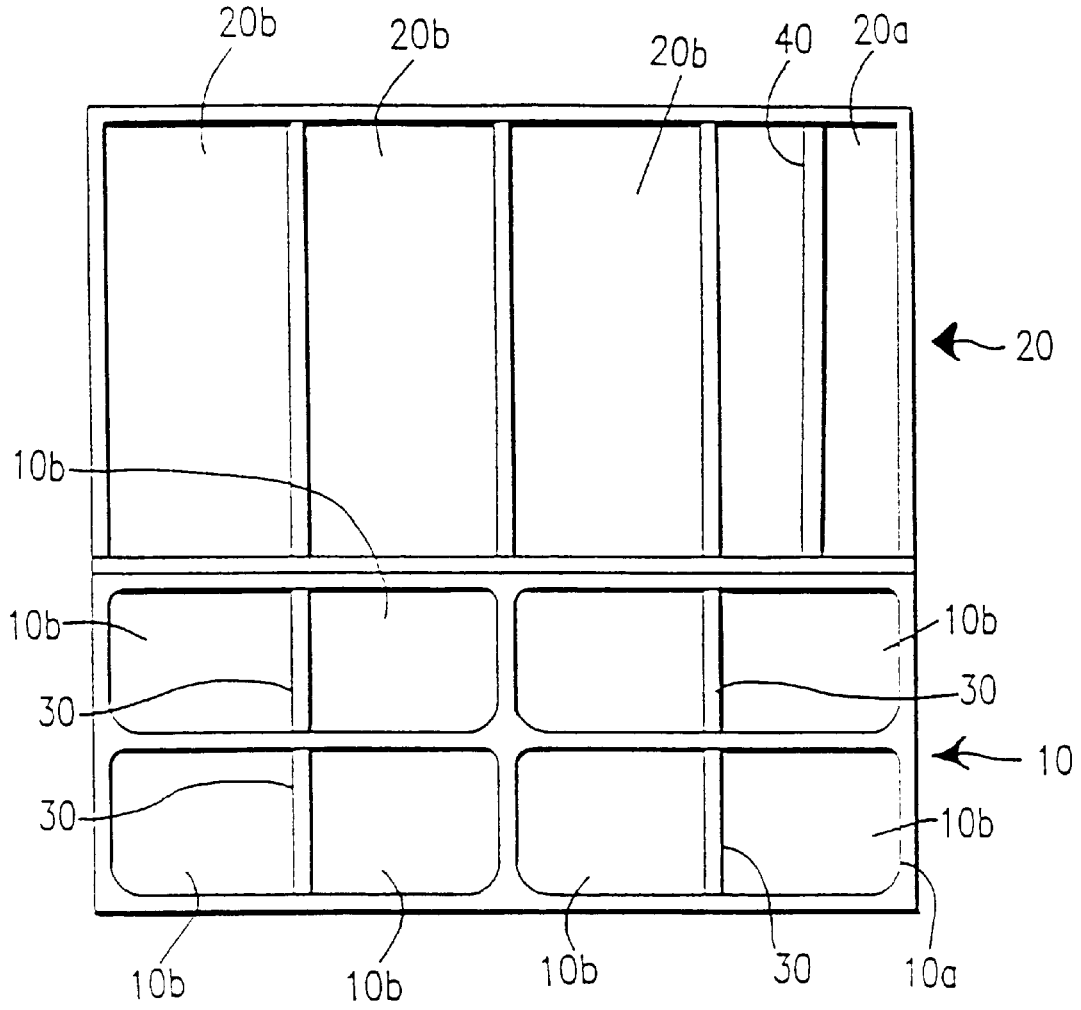
FIG. 2 is a plan view of the drawer box including the money case shown in FIG. 1.

FIGS. 1 through 5 illustrate a drawer box 100 in Example 1 according to the present invention. As shown in FIGS. 1 and 2, the drawer box 100 includes a money case 300. The money case 300 includes a casing 70 formed by resin-molding, a coin accommodation area 10 which is detachably engageable in a front portion of the casing 70, and a note accommodation area 20 provided posterior to the front portion of the casing 70.

The coin accommodation area 10 includes a plurality of coin accommodation parts 10*a* arranged in two rows, each row having two coin accommodation parts 10*a* in a width direction W of the money case 300. Each coin accommodation part 10*a* has two coin accommodation portions 10*b* separated from each other by a divider 30. The note accommodation area 20 includes a plurality of note accommodation parts 20*a* and 20*b* arranged in the width direction W of the money case 300.

The drawer box 100 of Example 1 adopts a divider rearrangement system (described in detail later) for the coin accommodation area 10, and a divider lifting and lowering system (described in detail later) for the note accommodation area 20.

The note accommodation area 20 which adopts the divider lifting and lowering system will be described below with reference to FIGS. 3A, 3B and 3C.

Figure 3A:
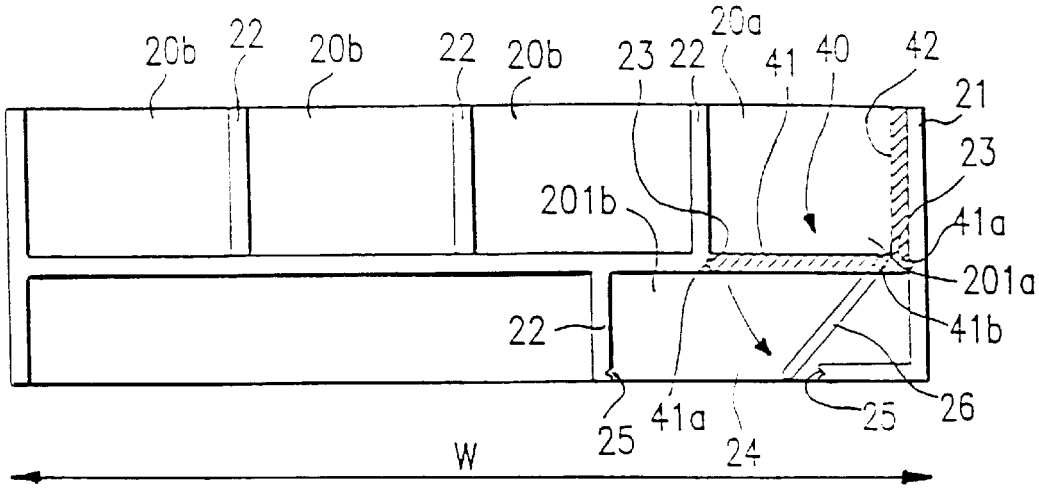
FIGS. 3A, 3B and 3C are each a cross-sectional view of the drawing box including the money case shown in FIG. 1 taken along line III—III, illustrating three different states of a note accommodation part of the drawer box including the money case.

As shown in FIG. 3A, the note accommodation area 20 includes one note accommodation part 20*a* of a first type and three note accommodation parts 20*b* of a second type. The note accommodation part 20*a* located at one end the note accommodation area 20 has a deep-bottomed shape having a depth substantially equal to the height of the money case 300. The note accommodation parts 20*b* have a shallow-bottomed shape having a depth substantially half of the height of the money case 300. The height of the money case 300 is substantially the same as that of the drawer box 100. The note accommodation part 20*a* has an upper portion 201*a* and a lower portion 201*b*, and the lower portion 201*b* is larger in the width direction W than the upper portion 201*a*. The note accommodation part 20*a* is placed between an L-shaped outer wall 21 and a laterally staggered inner wall 22 as illustrated in FIGS. 3A, 3B and 3C. An opening 24 is placed between bottom portions of the walls 21 and 22.

The note accommodation area 20 further includes a divider 40 having an L-shaped cross section. The divider 40 has a bottom plate 41 for separating the upper portion 201*a* from the lower portion 201*b* (FIG. 3A), and an upright portion 42 extended perpendicularly from one end of the bottom plate 41.

On each of two side surfaces of the bottom plate 41 of the divider 40 extending perpendicular to the width direction W, a convex portion 41*a* is provided along the entire length thereof. Likewise, a projection 41*b* is provided on each of a front and a back surface of the bottom plate 41 extending in the width direction W (only the one on the back surface is shown).

The walls 21 and 22 each have a concave portion 23 at an intermediate position thereof in which each convex portion 41*a* of the divider 40 is engageable. Each of the walls 21 and 22 also has a concave portion 25 at a bottom position thereof in which each convex portion 41*a* of the divider 40 is also engageable.

Within the front and back walls of the note accommodation part 20*a* are provided grooves 26 extending from an intermediate position to a bottom position in an inwardly inclined manner. The projections 41*b* of the divider 40 are respectively slidable along the grooves 26.

Next, the operation of the drawer box 100 will be described with reference to FIGS. 3A, 3B and 3C.

As shown in FIG. 3A, the divider 40 is normally held so as to allow the bottom plate 41 to be horizontally held in the intermediate level of the note accommodation part 20*a*. In other words, the convex portions 41*a* provided on the side surfaces of the bottom plate 41 fit into the concave portions 23 which are formed in the intermediate positions of the two walls 21 and 22. The convex portions 41*a* and the concave portions 23 function as a first holding device. The upright portion 42 of the divider 40 is substantially entirely in contact with the wall 21. In such a state, the upper portion 201*a* acts as a shallow-bottomed note accommodation part similar to the adjacent note accommodation parts 20*b*. Notes can be accommodated horizontally in the note accommodation part.

Figure 3B:
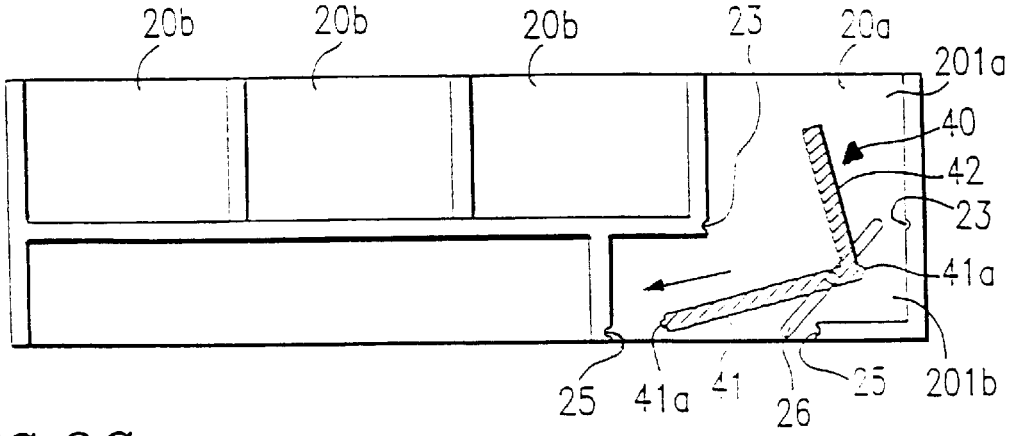
Figure 3C:
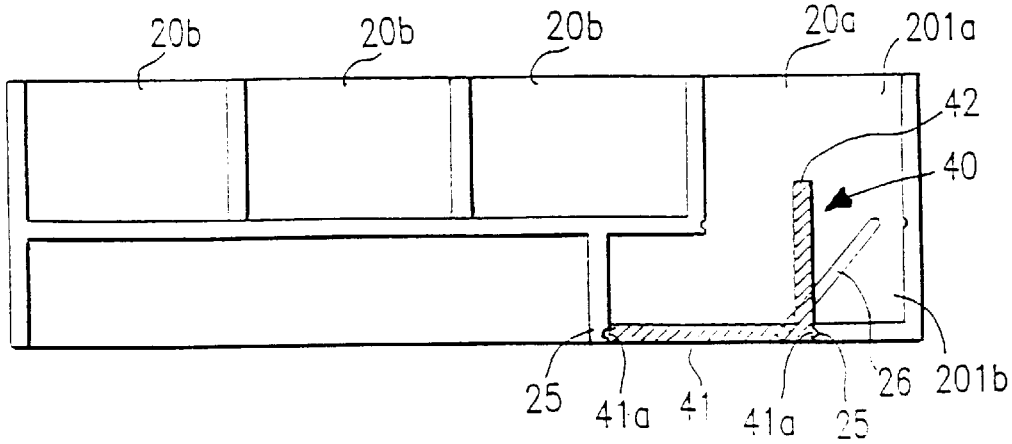

In the case where there are many types of notes to be accommodated, the divider 40 is swung slightly, disengaging the convex portions 41*a* of the divider 40 from the concave portions 23 as shown in FIG. 3B. This causes the divider 40 to slide obliquely downward by a sliding movement of the projections 41*b* along the inclined grooves 26. The projections 41*b* and the grooves 26 function together as a guide device. Then, as shown in FIG. 3C, the divider 40 is lowered to the point where the convex portions 41*a* are fitted into the concave portions 25, thereby locking the bottom plate 41 in the opening 24 at a bottom position. The convex portions 41*a* and the concave portions 25 function as a second holding device.

When the bottom plate 41 lowers, the upright portion 42 also moves inwardly while lowering. In the state where the bottom plate 41 is locked at the bottom position of the note accommodation part 20*a*, the upright portion 42 is held securely in a position which divides the note accommodation part 20*a* into two side portions. In this state, the upper portion 201*a* and the lower portion 201*b* act together as a deep-bottomed note accommodation part. Notes can be accommodated vertically.

Next, the coin accommodation area 10 adopting the divider rearrangement system will be described.

Figure 4A:
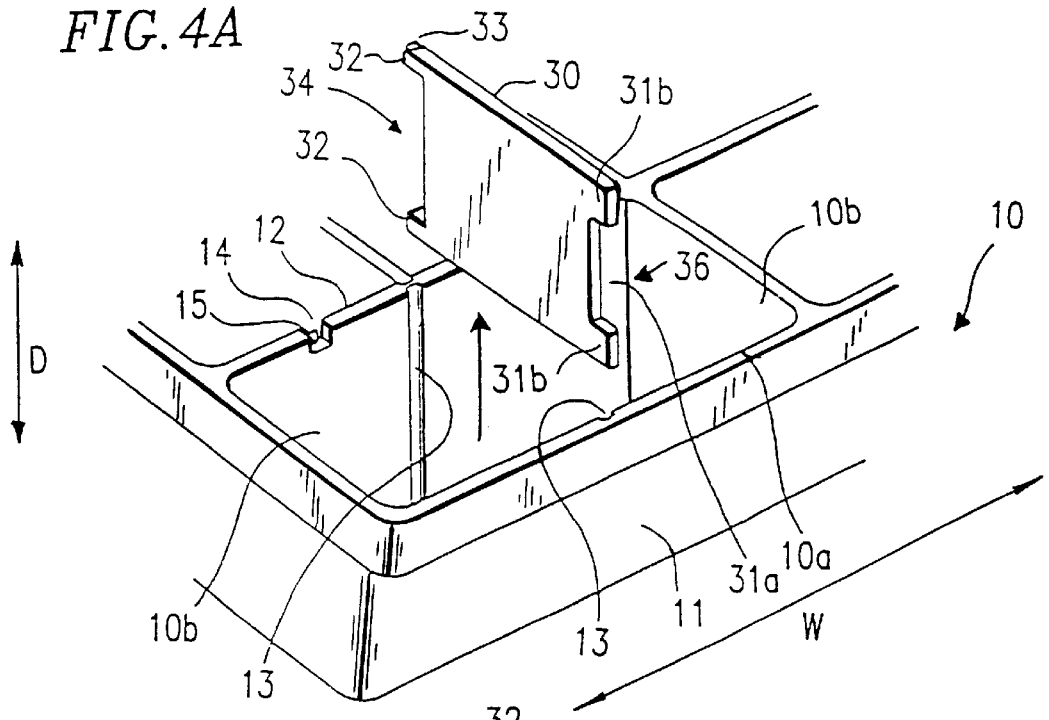
FIGS. 4A and 4B are each a perspective view of the drawer box including the money case shown in FIG. 1 illustrating two different states of a coin accommodation part of the drawing box including the money case.
Figure 4B:
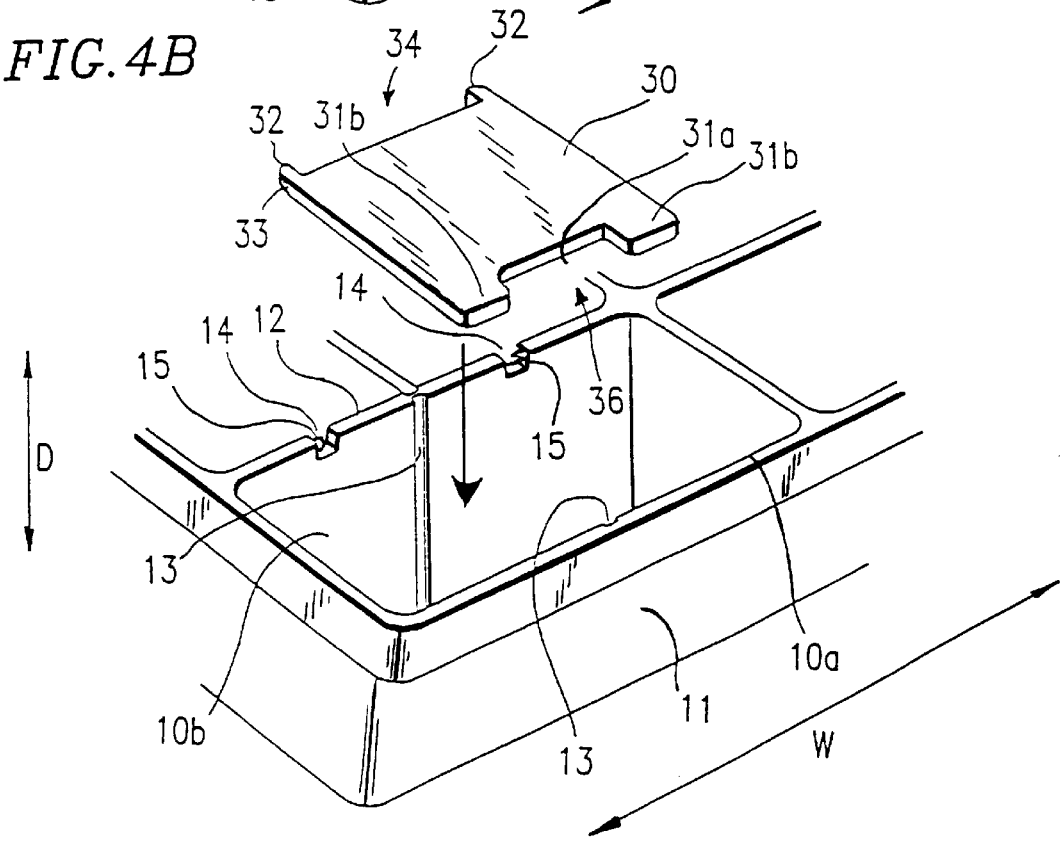

As shown in FIGS. 4A and 4B, the coin accommodation area 10 includes the coin accommodation parts 10*a* divided into two coin accommodation portions 10*b* by the removable divider 30.

The divider 30 has projections 31*b* and a cut-out 31*a* on a front edge 36, and a pair of projections 32 on both of two ends of a rear edge 34 of the divider 30. Each projection 32 has a rounded concave portion 33 in an outer surface thereof.

The coin accommodation part 10*a* is placed between walls 11 and 12. The walls 11 and 12 each has a groove 13 extending in a depth direction (arrow D). The projections 31*b* and the projections 32 are engageable with the grooves 13. When the divider 30 is vertically secured in the coin accommodation part 10*a* through the engagement of the projections 31*b* and one of the grooves 13, and the projections 32 and the other groove 13, the coin accommodation part 10*a* is divided into two coin accommodation portions 10*b*. The projections 31*b* and 32, and the grooves 13 function as a first holding device.

Figure 5:
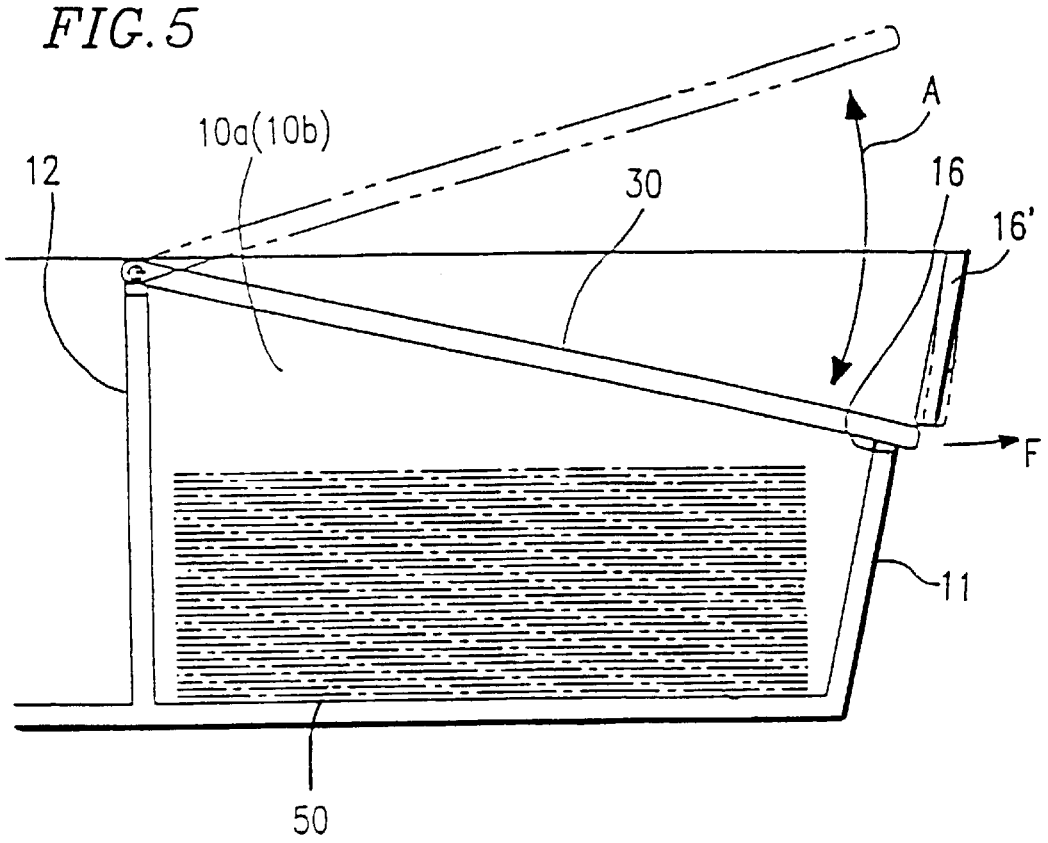
FIG. 5 is a cross-sectional view of the drawer box including the money case shown in FIG. 1 taken along line V—V, illustrating a method for operating a hinged divider for the coin accommodation part of the drawing box including the money case.

As best shown in FIG. 4B, the wall 12 has concave portions 14 in the top edge thereof, in which the projections 32 of the divider 30 are engageable. The wall 12 has projections 15 projecting into the concave portions 14, wherein the projections 15 are engageable in the concave portions 33 which exist within the projections 32 of the divider 30. The concave portions 33 and the projections 15 function as a second holding device in a form of a hinge for attaching the divider 30 to the wall 12. The divider 30 pivots in a direction of arrow A, as illustrated in FIG. 5. The wall 11 has a slit 16. When the divider 30 is pivotally attached to the wall 12, a free end of the divider 30, i.e., the projections 31*b*, is engageable in the slit 16. The slit 16 and the projections 31*b* function as a locking device for locking the divider 30 to the wall 11.

As shown in FIGS. 1 and 2, the divider 30 is normally inserted vertically into the grooves 13, thereby acting as a partition between the coin accommodation portions 10*b*. In the case where there are many kinds of notes to be accommodated, the divider 30 is pulled out of the grooves 13 as shown in FIG. 4A. In this state, the coin accommodation part 10*a* acts as a note accommodation part, wherein the notes are accommodated horizontally. Thus, an additional note accommodation space is obtained.

After the divider 30 is pulled out, the divider 30 is turned horizontally (FIG. 4B). Then, the projections 32 of the divider 30 are fit into the concave portions 14, and the projections 15 are fit into the concave portions 33. This causes the divider 30 to be hinged to the top edge of the wall 12 with the rear edge 34 serving as a fulcrum (horizontal axis). Then, the free end of the hinged divider 30 is swung and pressed downward with the projections 31*b* pressed against a note-weight locking device 16' to the point where the projections 31*b* are inserted into the slit 16.

The note-weight locking device 16' is made of resin. Accordingly, when the tips of the projections 31*b* of the divider 30 touch the note-weight locking device 16', the note-weight locking device 16' elastically deforms in a forward direction (arrow F) in FIG. 5. Then, when the projections 31*b* reach the slit 16, the note-weight locking device 16' recovers the original shape thereof due to elasticity, thus holding the divider 30 as shown by a solid line in FIG. 5. In this state, the divider 30 functions as a weight for notes 50 accommodated in the coin accommodation part 10*a*. This prevents the notes 50 from jumping out of the drawer box 100 when the drawer box 100 is opened and closed even though the note accommodation part is created in the front portion of the money case 300.

It is needless to say that papers and the like such as gift tokens and checks can be accommodated in the note accommodation part.

EXAMPLE 2

Figure 6A:
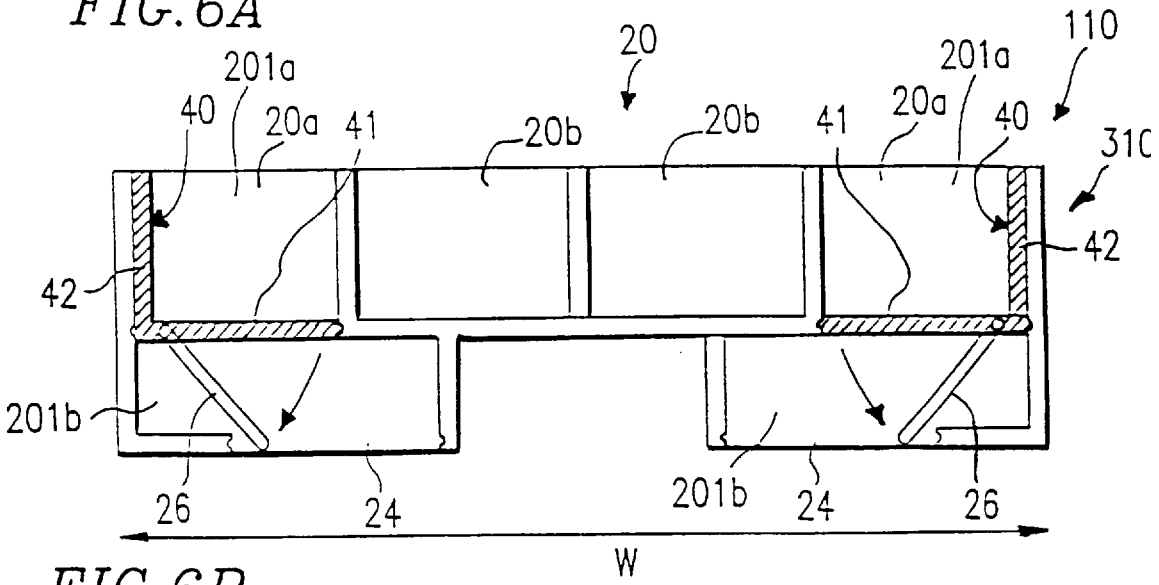
FIGS. 6A, 6B and 6C are each a cross-sectional view of a drawer box including a money case in Example 2 according to the present invention seen from the front, illustrating three different states of the note accommodation parts of the drawer box including the money case.
Figure 6B:
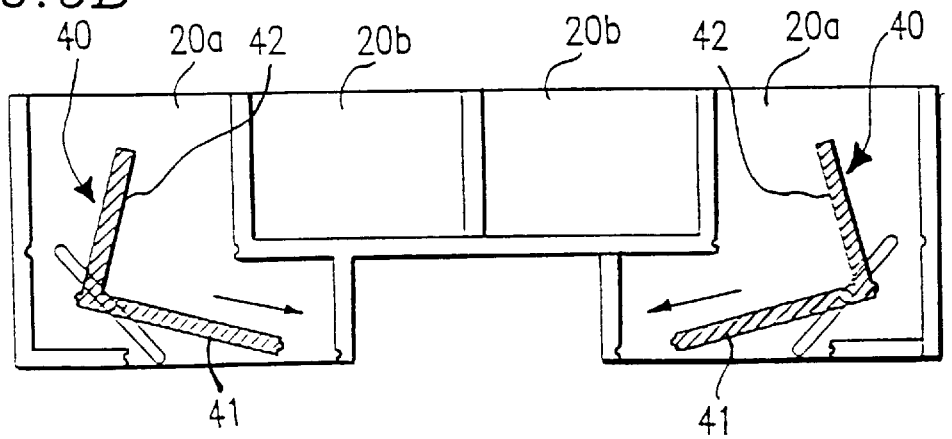
Figure 6C:
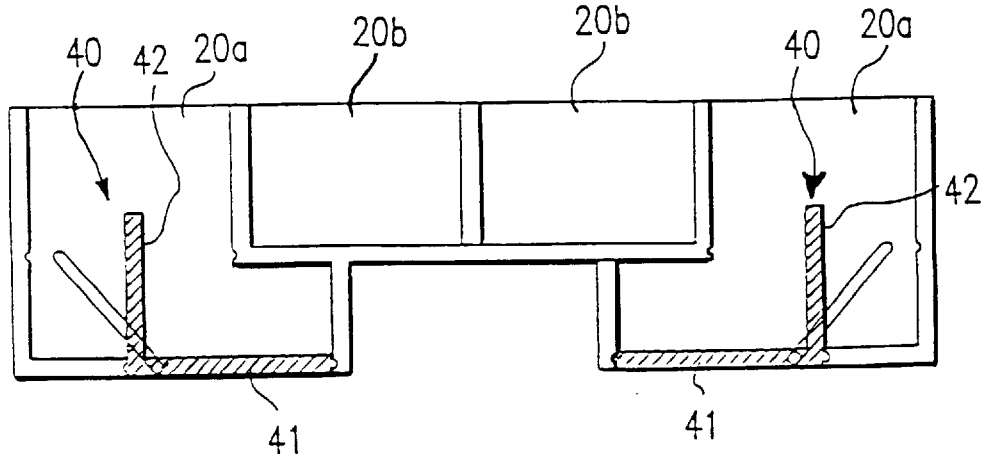
Figure 7A:
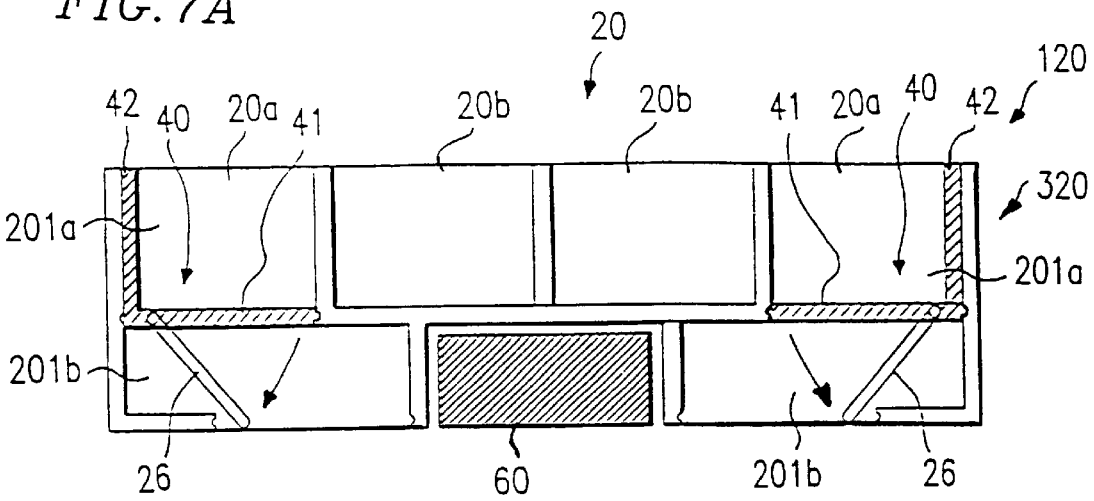
FIGS. 7A, 7B and 7C are each a cross-sectional view of a drawer box including a money case in Example 3 according to the present invention seen from the front, illustrating three different states of the note accommodation parts of the drawer box including the money case.
Figure 7B:
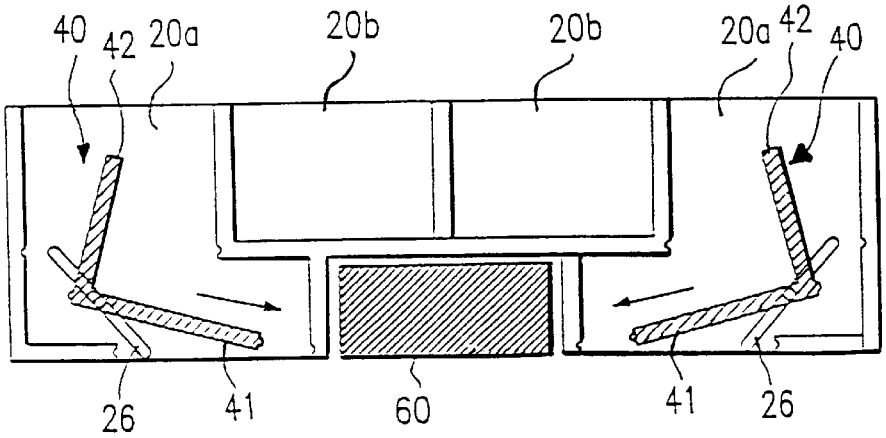
Figure 7C:
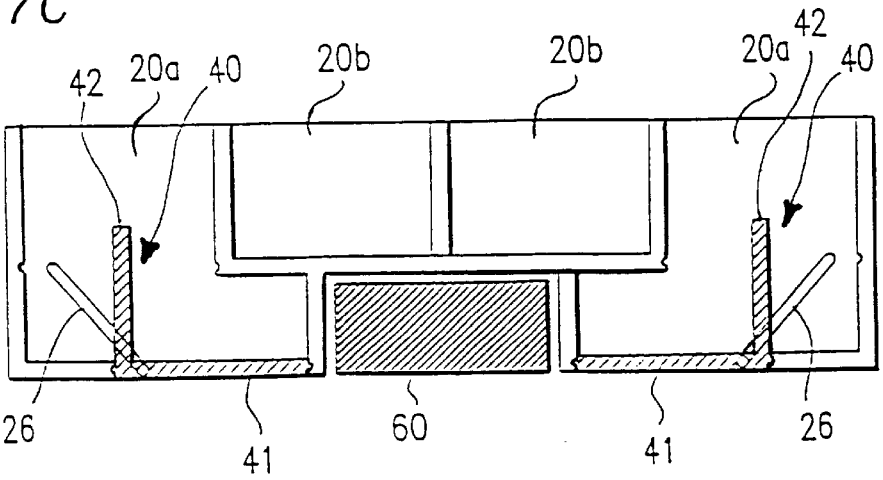

FIGS. 6A, 6B and 6C illustrate a drawer box 110 including a money case 310 in Example 2 according to the present invention. Like the drawer box 100 in Example 1, the drawer box 110 adopts the divider lifting and lowering system for the note accommodation area 20 in the money case 310. The drawer box 110 is different from the drawer box 100 in that the drawer box 110 has two note accommodation parts 20*a* located at both of two ends of a row having four note accommodation parts arranged in a width direction W of the money case 310. The note accommodation parts 20*a* include the divider 40 and have a deep-bottomed shape. This further provides an additional note accommodation space. The two note accommodation parts 20*b* placed between the note accommodation parts 20*a* have a shallow bottomed shape.

EXAMPLE 3

FIGS. 7A, 7B, 7C, 8A, 8B and 8C illustrate a drawer box 120 including a money case 320 in Example 3 according to the present invention. Like the drawer boxes 100 and 110 in Examples 1 and 2, the drawer box 120 adopts the divider lifting and lowering system for the note accommodation area 20 in the money case 320. As in Example 2, two note accommodation parts 20*a* of a deep-bottomed shape including the divider 40 are provided at both of two ends of the row. The drawer box 120 is different from the drawer box 110 in Example 2 in that a lock unit 60 for maintaining the drawer box 120 in an opened or closed state is provided under the two note accommodation parts 20*b* which have a shallow-bottomed shape and are sandwiched between the note accommodation parts 20*a*.

Since the lock unit 60 is commonly used, a detailed description thereof is omitted.

Figure 8A:
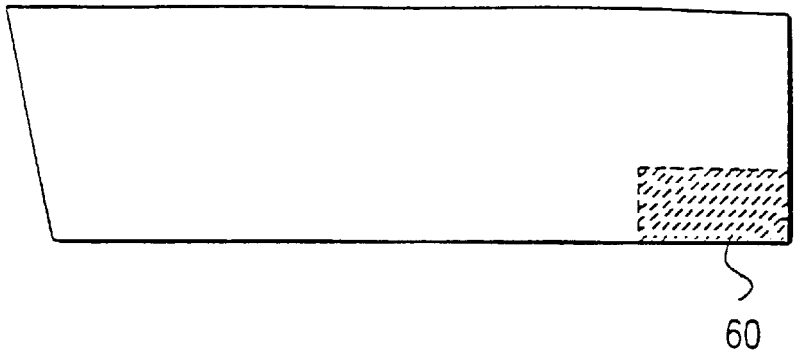
FIG. 8A is a side view of the drawer box including the money case shown in FIGS. 7A, 7B and 7C.
Figure 8B:
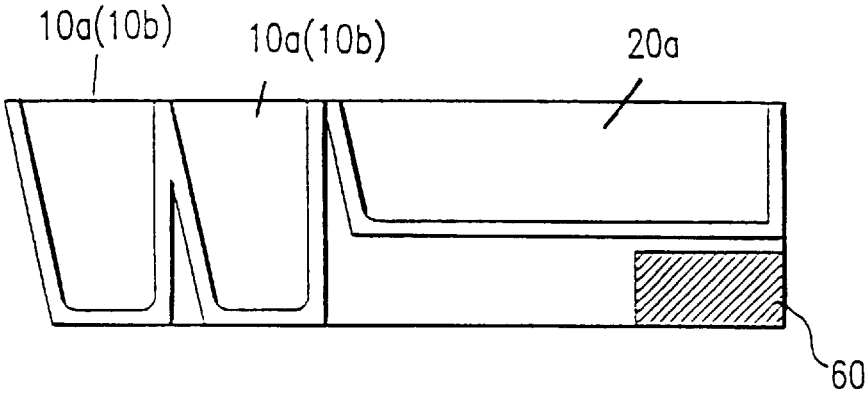
FIG. 8B is a cross-sectional view of the drawer box including the money case shown in FIGS. 7A, 7B and 7C seen from a side.
Figure 8C:
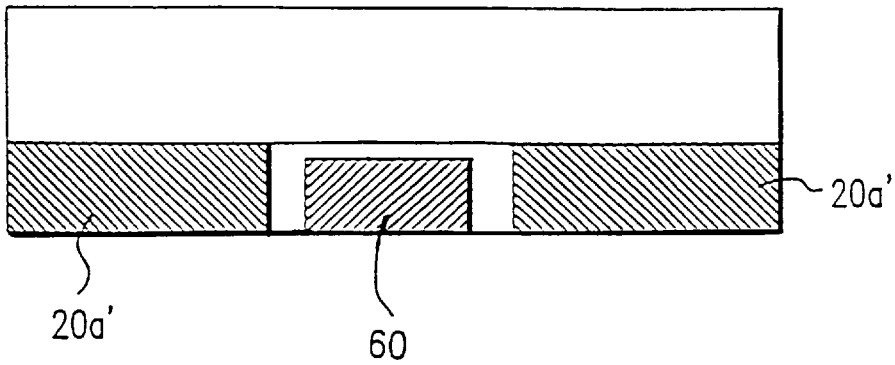
FIG. 8C is a cross-sectional view of the drawer box including the money case shown in FIGS. 7A, 7B and 7C seen from the front.

As shown in FIGS. 8A and 8B, the lock unit 60 is normally provided at the rear end of the drawer box 120, under the note accommodation parts 20*b*. This structure is made possible by providing the note accommodation parts 20*a* at the two ends of the row and leaving the note accommodation parts 20*b* shallow-bottomed. As shown in FIG. 8C, by changing the manner of accommodating notes in the note accommodation parts 20*a* from horizontally to vertically, portions 20*a'* located on two sides of the lock unit 60 can be used as note accommodation space, thereby increasing the whole note accommodation space.

EXAMPLE 4

Figure 9A:
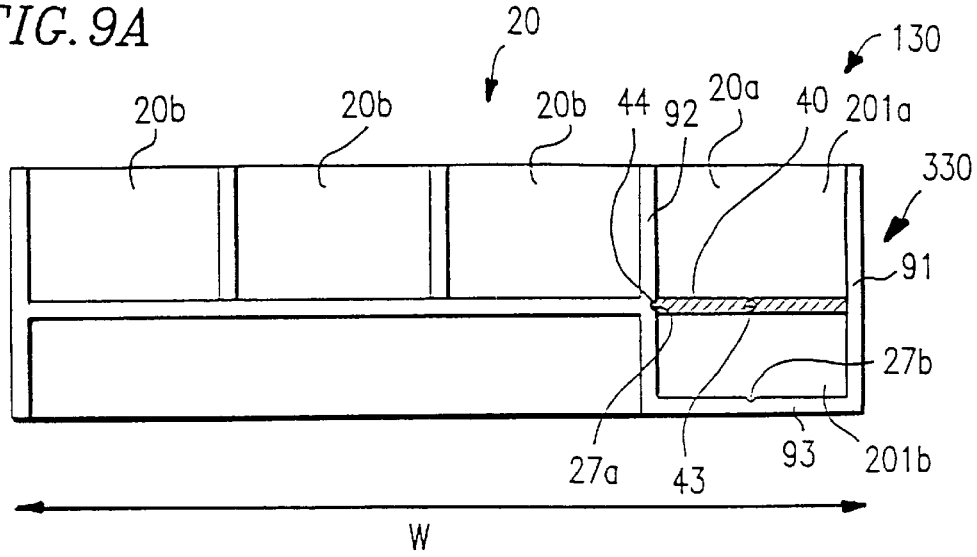
FIGS. 9A and 9B are each a cross-sectional view of a drawer box including a money case in Example 4 according to the present invention seen from the front, illustrating two different states of the note accommodation part of the drawer box including the money case.
Figure 9B:
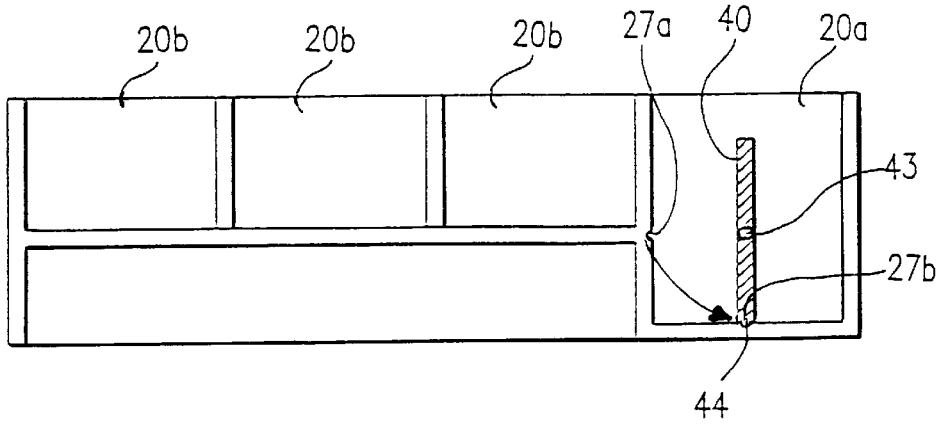

FIGS. 9A and 9B illustrate a drawer box 130 including a money case 330 in Example 4 according to the present invention. The drawer box 130 adopts a divider pivoting system for the note accommodation area 20 in the money case 330. The note accommodation area 20 includes one note accommodation part 20*a* having an upper portion 201*a* and a lower portion 201*b* and a plurality of note accommodation parts 20*b*. Both note accommodation parts 20*a* and 20*b* are arranged in a width direction W of the money case 330. The divider 40 is provided to separate the upper portion 201*a* from the lower portion 201*b* (FIG. 9A). The note accommodation part 20*a* is partially surrounded by an outer wall 91, an inner wall 92 and a bottom plate 93.

The divider 40 includes a projection 43 in the middle of each of a front and a back surface thereof. The front and back walls of the note accommodation part 20*a* each have a concave portion (not shown) in which the projection 43 is engageable. The projections 43 function as a supporting device for pivotally supporting the divider 40 in an intermediate portion between the front and back walls of the note accommodation part 20*a*. The projections 43 may be positioned at other positions as long as the divider 40 can be held in a horizontal and a vertical position. One side surface of the divider 40 extending perpendicular to the width direction W has a convex portion 44 provided along the entire length thereof. The inner wall 92 has a concave portion 27*a* in which the convex portion 44 is engageable so as to hold the divider 40 substantially horizontally. Alternatively, the outer wall 91 may have the concave portion 27*a*. The convex portion 44 and the concave portion 27*a* function as a first holding device. The top surface of the bottom plate 93 has a concave portion 27*b* in which the convex portion 44 is engageable so as to hold the divider 40 in a substantially vertical position which divides the note accommodation part 20*a* into two side portions. The convex portion 44 and the concave portion 27*b* function as a second holding device.

Normally, the divider 40 is held horizontally in an intermediate level by fitting the convex portion 44 in the concave portion 27*a* as shown in FIG. 9A. In this state, the upper portion 201*a* acts as a note accommodation part of a shallow-bottomed shape similar to the note accommodation parts 20*b*. In this manner notes can be accommodated horizontally.

In the case where there are many kinds of notes to be accommodated, the divider 40 is pivoted, thereby disengaging the convex portion 44 from the concave portion 27*a* and fitting the convex portion 44 into the concave portion 27*b* as shown in FIG. 9B. This changes the position of the divider from horizontal to vertical, thereby dividing the note accommodation part 20*a* into two side portions having a deep-bottom shape. In this manner notes can be accommodated vertically. This increases the note accommodation space without increasing the width of the drawer box 130.

Furthermore, since notes can be accommodated vertically in the note accommodation space, the notes can be deposited and retrieved and recognized more easily.

EXAMPLE 5

Figure 10A:
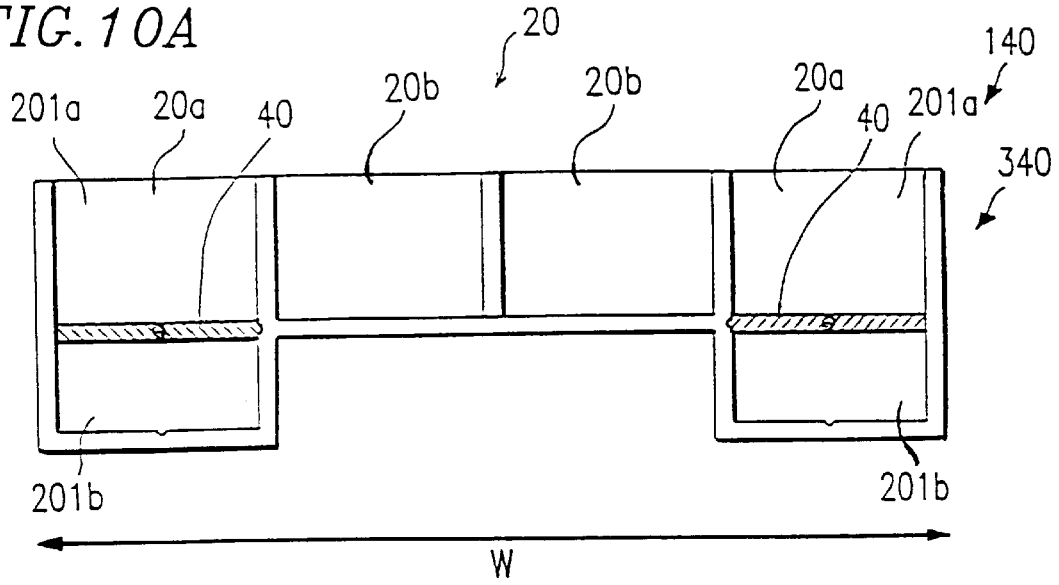
FIGS. 10A and 10B are each a cross-sectional view of a drawer box including a money case in Example 5 according to the present invention seen from the front, illustrating two different states of the note accommodation parts of the drawer box including the money case.
Figure 10B:
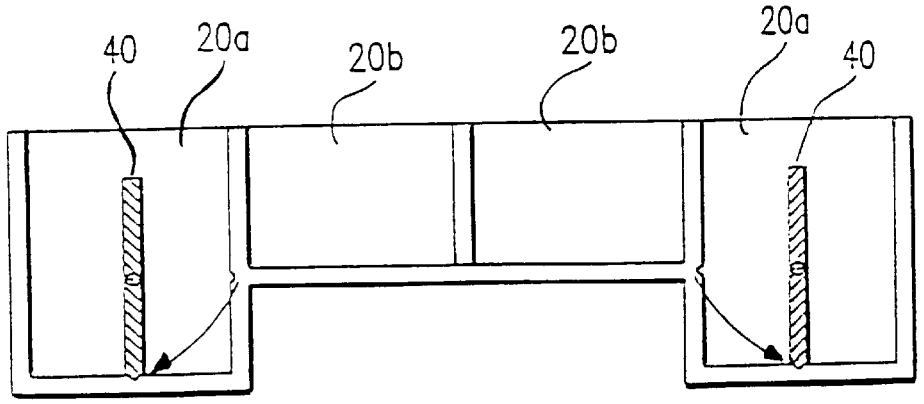

FIGS. 10A and 10B illustrate a drawer box 140 including a money case 340 in Example 5 according to the present invention. Like the drawer box 130 in Example 4, the drawer box 140 adopts the divider pivoting system for the note accommodation area 20 in the money case 340. The drawer box 140 is different from the drawer box 130 in that the drawer box 140 has two note accommodation parts 20*a* located at both of two ends of a row having the four note accommodation parts arranged in a width direction W of the money case 340. The note accommodation parts 20*a* include the divider 40 and have a deep-bottomed shape. This further provides an additional accommodation space. The two note accommodation parts 20*b* placed between the note accommodation parts 20*a* have a shallow bottomed shape.

EXAMPLE 6

Figure 11A:
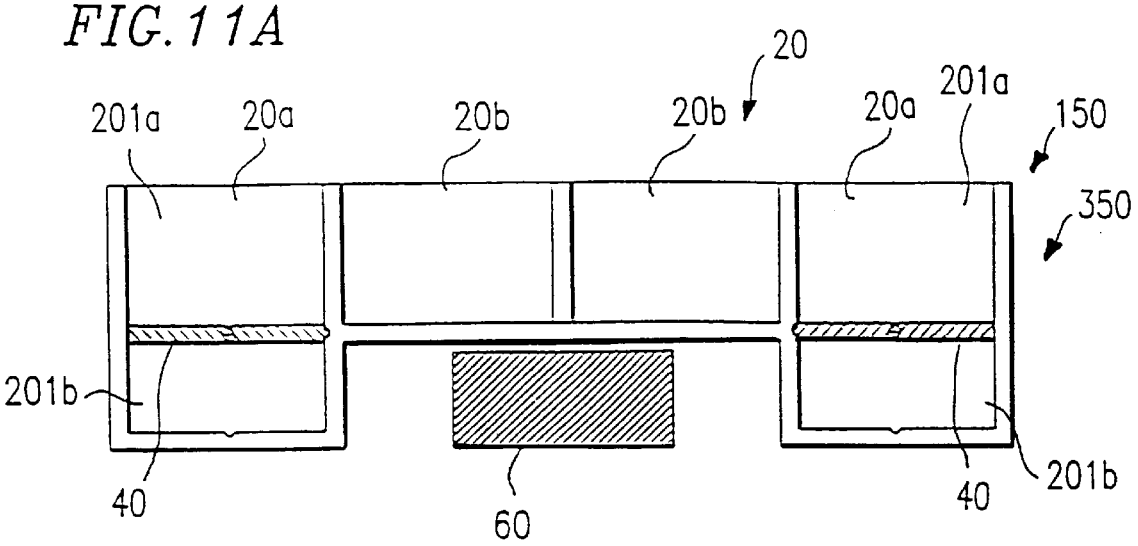
FIGS. 11A and 11B are each a cross-sectional view of a drawer box including a money case in Example 6 according to the present invention seen from the front, illustrating two different states of the note accommodation parts of the drawer box including the money case.
Figure 11B:
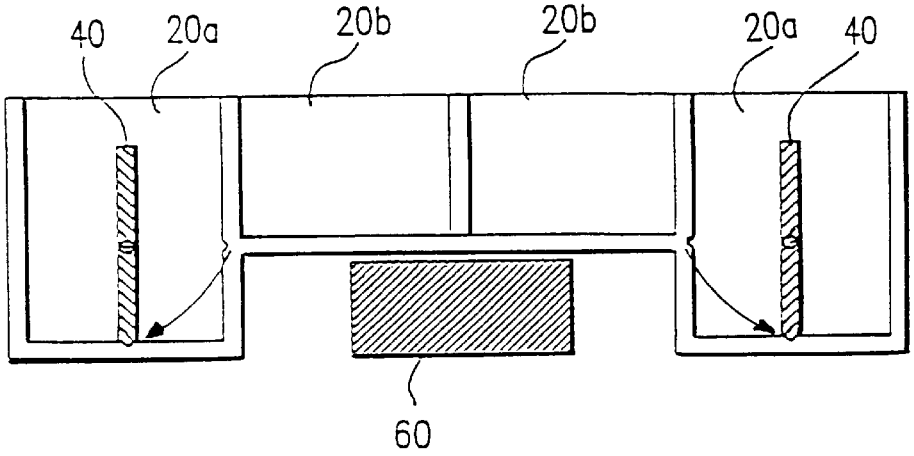
Figure 12A:
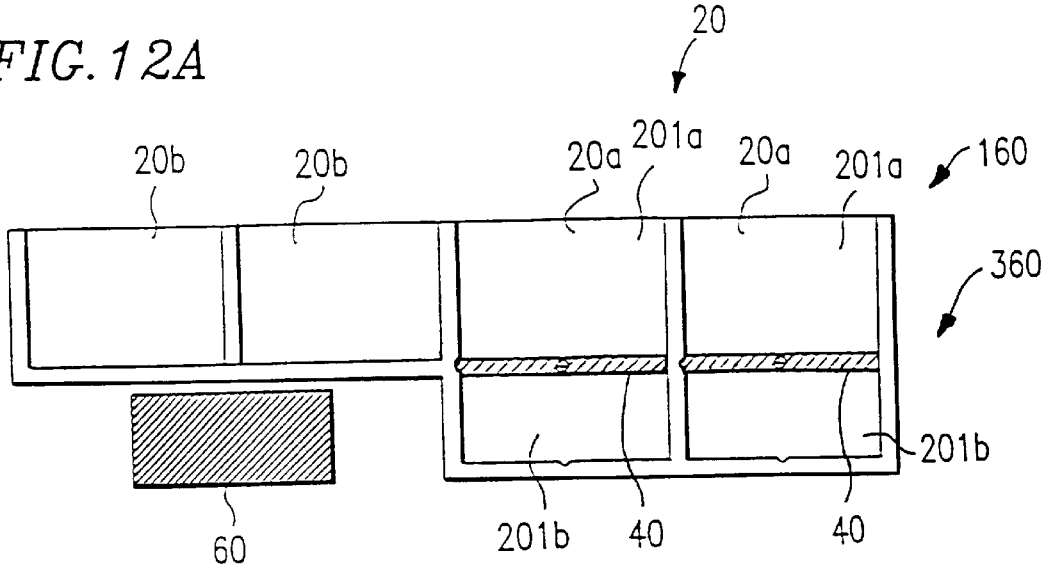
FIGS. 12A and 12B are each a cross-sectional view a drawer box including a money case in Example 7 according to the present invention seen from the front, illustrating two different states of the note accommodation parts of the drawer box including the money case.
Figure 12B:
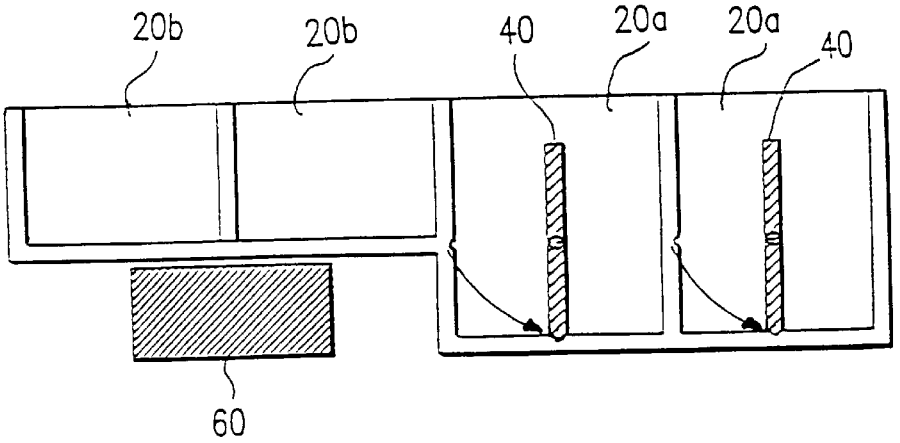
Figure 13A:
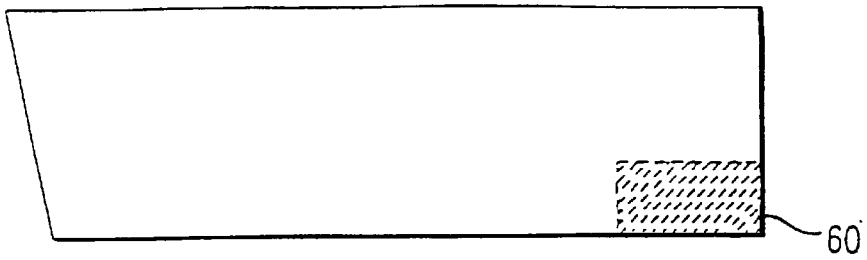
FIG. 13A is a side view of the drawer box including the money case shown in FIGS. 12A and 12B.
Figure 13B:
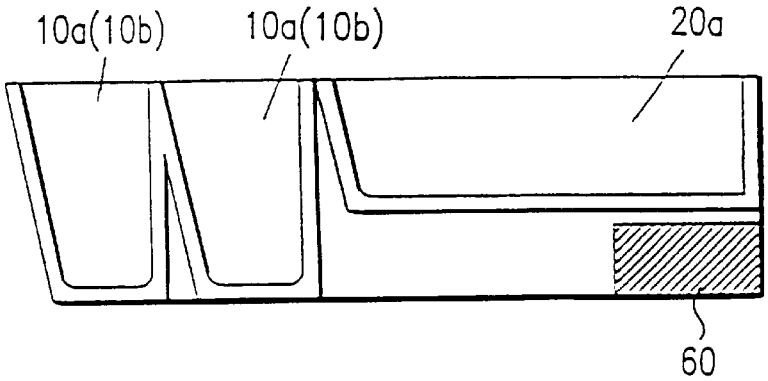
FIG. 13B is a cross-sectional view of the drawer box including the money case shown in FIGS. 12A and 12B seen from a side.
Figure 13C:
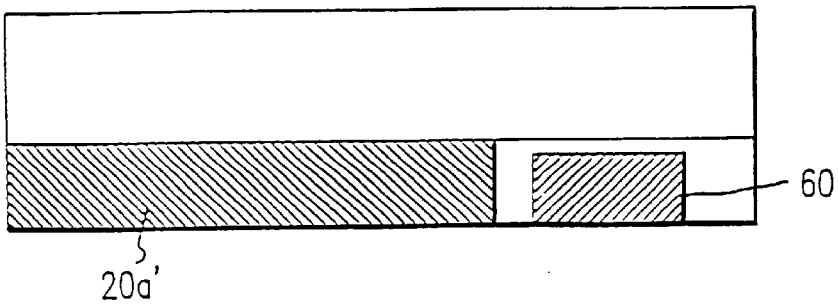
FIG. 13C is a cross-sectional view of the drawer box including the money case shown in FIGS. 12A and 12B seen from the front.

FIGS. 11A and 11B illustrate a drawer box 150 including a money case 350 in Example 6 according to the present invention. Like the drawer boxes 130 and 140 in Examples 4 and 5, the drawer box 150 adopts the divider pivoting system for the note accommodation area 20 in the money case 350. As in Example 5, two note accommodation parts 20*a* of a deep-bottomed shape including the divider 40 are provided at both of two ends of the row. The drawer box 150 is different from the drawer box 140 in Example 5 in that a lock unit 60 for maintaining the drawer box 150 in an opened or closed state is provided under the two note accommodation parts 20*b* which have a shallow-bottomed shape and are sandwiched between the note accommodation parts 20*a*.

By providing the note accommodation parts 20*a* at both of two ends of the row and leaving the note accommodation parts 20*b* shallow-bottomed, the note accommodation space can be increased without sacrificing installment space for the lock unit 60.

EXAMPLE 7

FIGS. 12A, 12B, 13A, 13B and 13C illustrate a drawer box 160 including a money case 360 in Example 7 according to the present invention. Like the drawer boxes 130, 140 and 150 in Examples 4, 5 and 6, the drawer box 160 adopts the divider pivoting system for the note accommodation area 20 in the money case 360. The note accommodation area 20 of Example 7 is different from those of Examples 4, 5 and 6 in that the two note accommodation parts 20*a* are located at one end of the row and include the divider 40 and have a deep-bottomed shape. The lock unit 60 is provided under the two note accommodation parts 20*b* of a shallow-bottomed shape.

By providing the note accommodation parts 20*a* at one end of the row, the lock unit 60 can be provided under the note accommodation parts 20*b* of a shallow-bottomed shape as in a conventional manner. By changing the manner of accommodating notes in the note accommodation parts 20*a* from horizontally to vertically, portions 20*a'* located on one side of the lock unit 60 can be used as note accommodation space (FIG. 13C), thereby increasing the whole note accommodation space. The note accommodation space can therefore be increased without sacrificing installment space for the lock unit 60 as in Example 6.

EXAMPLE 8

Figure 14A:
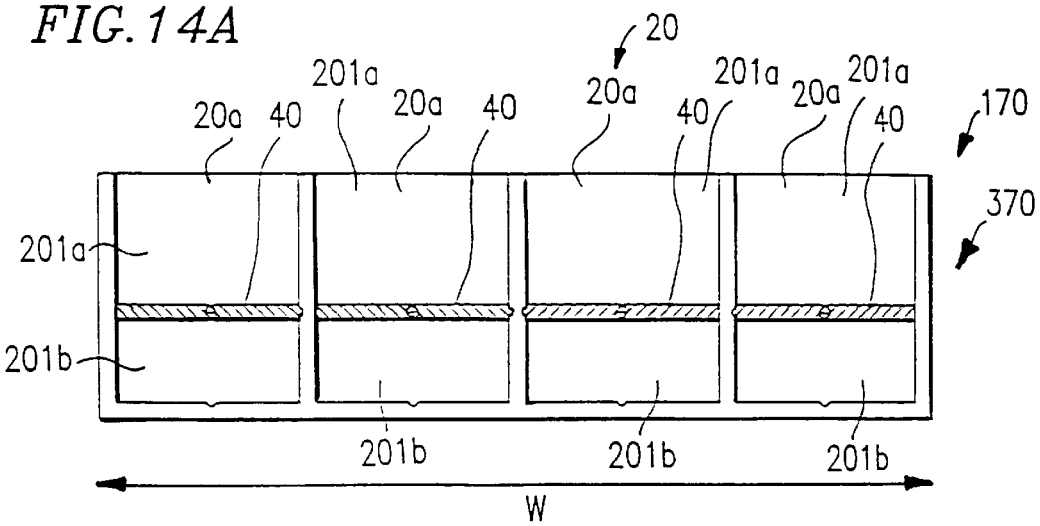
FIGS. 14A and 14B are each a cross-sectional view of a drawer box including a money case in Example 8 according to the present invention seen from the front, illustrating two different states of the note accommodation parts of the drawer box including the money case.
Figure 14B:
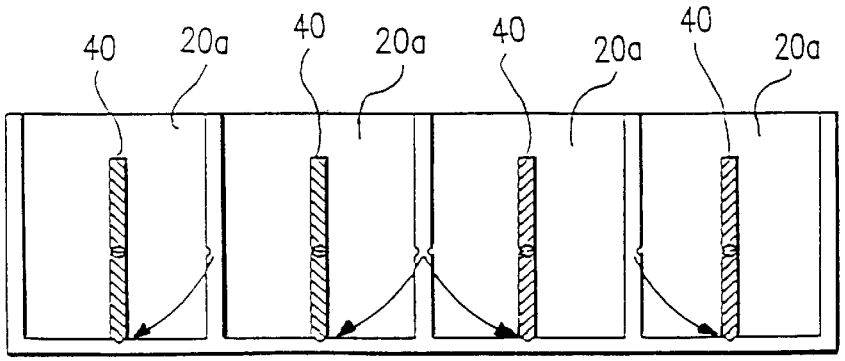

FIGS. 14A and 14B illustrate a drawer box 170 including a money case 370 in Example 8 according to the present invention. Like the drawer boxes 130, 140, 150, and 160 in Examples 4, 5, 6 and 7, the drawer box 170 adopts the divider pivoting system for the note accommodation area 20 in the money case 370. The note accommodation area 20 of Example 8 is different from those of Examples 4, 5, 6 and 7 in that all the note accommodation parts 20*a* are arranged in a width direction W of the money case 370 and have a deep-bottomed shape with the divider 40. This remarkably increases the note accommodation space.

EXAMPLE 9

Figure 15A:
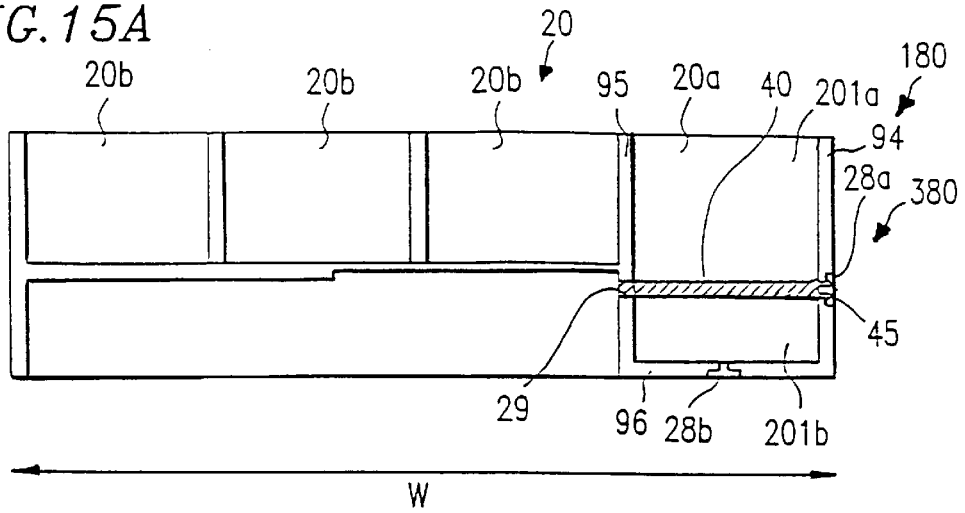
FIGS. 15A, 15B, 15C, and 15D are each a cross-sectional view of a drawer box including a money case in Example 9 according to the present invention seen from the front, illustrating four different states of the note accommodation part of the drawer box including the money case.

FIGS. 15A, 15B, 15C and 15D illustrate a drawer box 180 including a money case 380 in Example 9 according to the present invention. The drawer box 180 adopts the divider rearrangement system for the note accommodation area 20 in the money case 380. The note accommodation area 20 includes one note accommodation part 20*a* having an upper portion 201*a* and a lower portion 201*b* and a plurality of note accommodation parts 20*b*, wherein both are arranged in a width direction W of the money case 380. Further, the divider 40 separates the upper portion 201*a* from the lower portion 201*b* in the note accommodation part 20*a* (FIG. 15A). The note accommodation part 20*a* is partially surrounded by an outer wall 94, an inner wall 95 and a bottom plate 96.

The divider 40 includes a snapfit-type protrusion 45 on one end thereof. The outer wall 94 has a slit-like engagement portion 28*a* at an intermediate position thereof in which the protrusion 45 is engageable. The inner wall 95 has a slit 29 through which the divider is inserted so as to oppose the engagement portion 28*a*. The protrusion 45 and the engagement portion 28*a* serve as a first holding device for detachably holding the divider 40 in a position of separating the upper portion 201*a* from the lower portion 201*b* of the note accommodation part 20*a* (FIG. 15A). Alternatively, the inner wall 95 may have the engagement portion 28*a* and the outer wall 94 may have the slit 29. The bottom plate 96 has a slit-like engagement portion 28*b* on the middle portion of the top surface thereof in which the protrusion 45 is engageable. The protrusion 45 and the engagement portion 28*b* function as a second holding device for detachably holding the divider 40 in a position of dividing the note accommodation part 20*a* into two side portions.

Normally, the divider 40 is held horizontally in an intermediate level by the fitting the protrusion 45 provided on one end of the divider 40 into the engagement portion 28*a* and inserting the other end thereof into the slit 29 as shown in FIG. 15A. In this state, the upper portion 201*a* acts as a note accommodation part of a shallow-bottomed shape similar to the note accommodation parts 20*b*. In this manner notes can be accommodated horizontally.

Figure 15B:
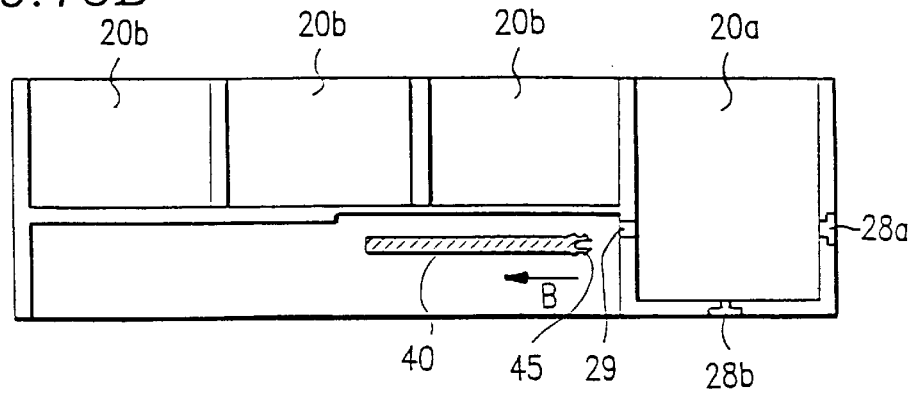
Figure 15C:
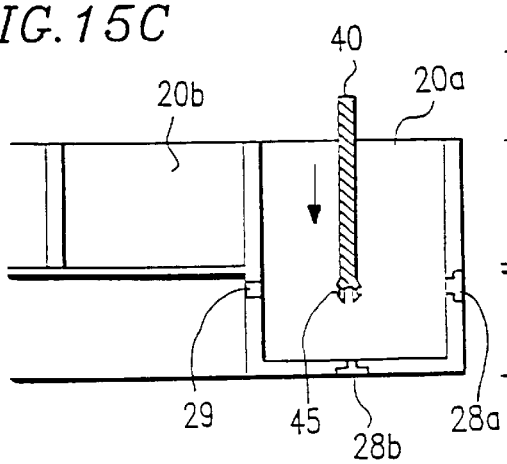
Figure 15D:
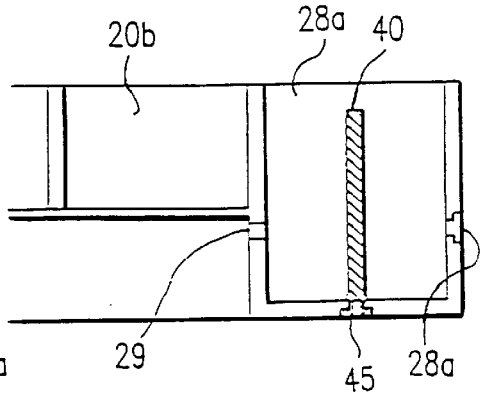
Figure 16A:
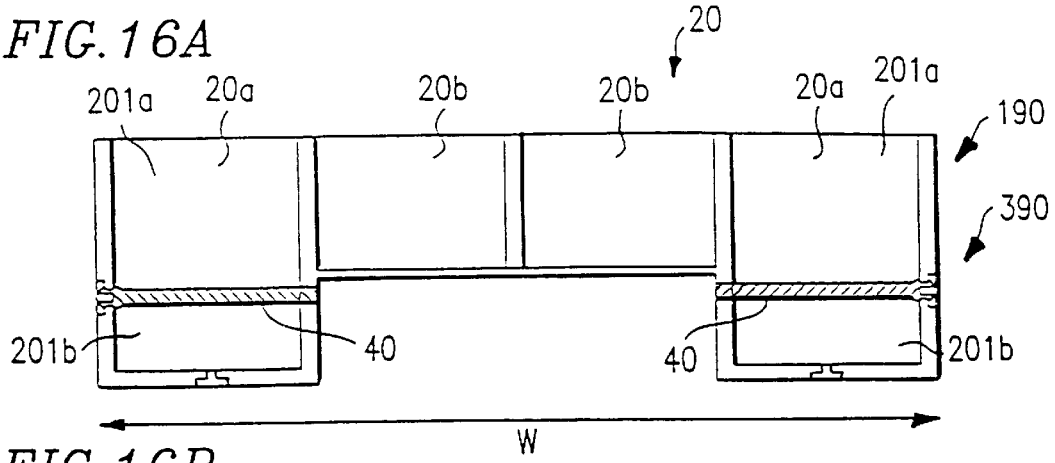
FIGS. 16A, 16B, 16C and 16D are each a cross-sectional view of a drawer box including a money case in Example 10 according to the present invention seen from the front, illustrating four different states of the note accommodation parts of the drawer box including the money case.
Figure 16B:
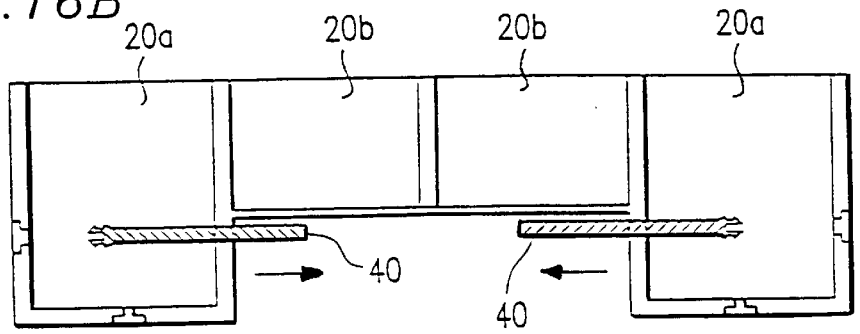
Figure 16C:
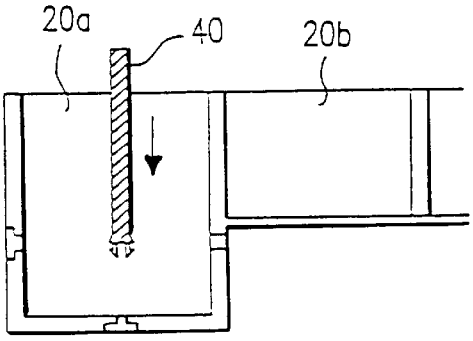
Figure 16D:
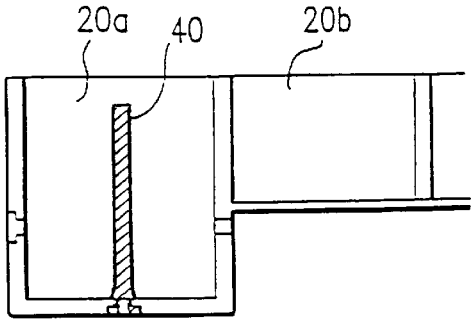
Figure 17A:
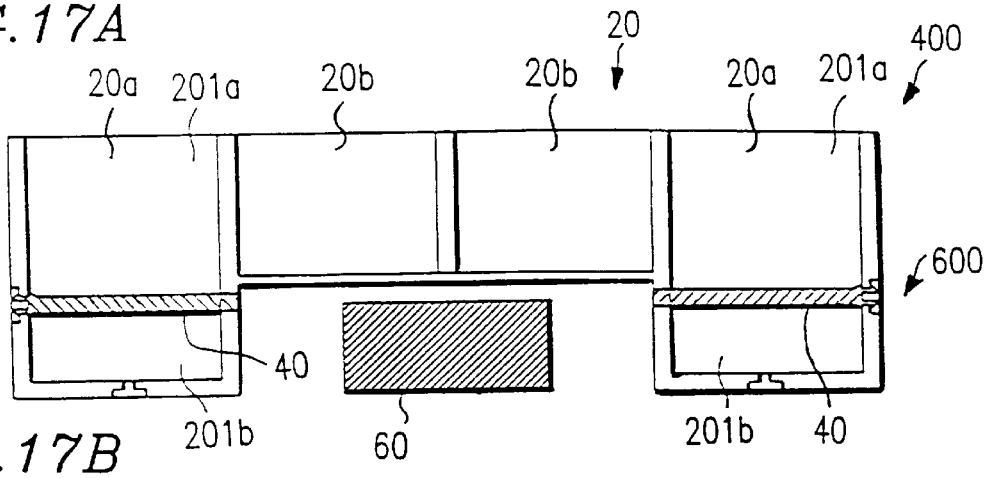
FIGS. 17A, 17B, 17C and 17D are each a cross-sectional view of a drawer box including a money case in Example 11 according to the present invention seen from the front, illustrating four different states of the note accommodation parts of the drawer box including the money case.
Figure 17B:
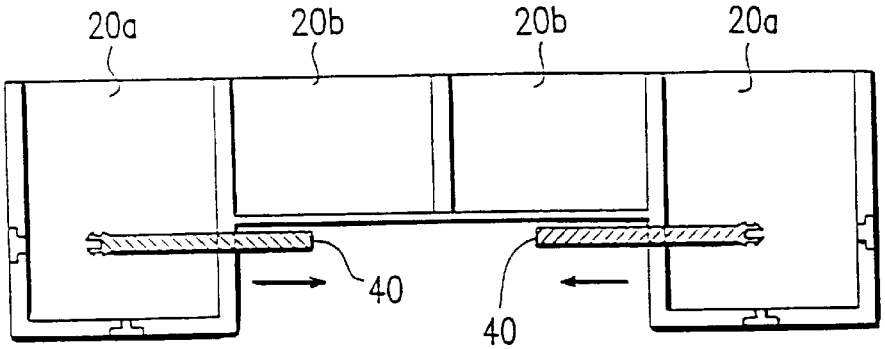
Figure 17C:
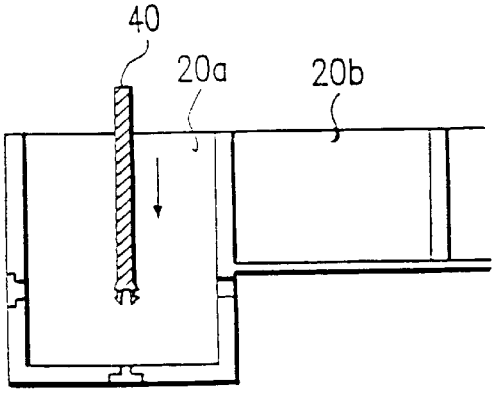
Figure 17D:
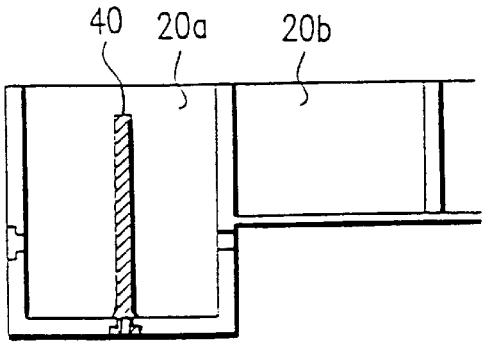
Figure 18A:
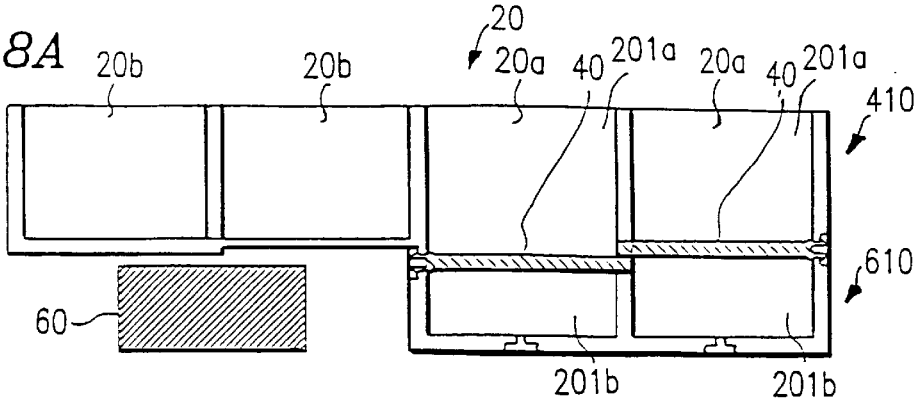
FIGS. 18A, 18B, 18C and 18D are each a cross-sectional view of a drawer box including a money case in Example 12 according to the present invention seen from the front, illustrating four different states of the note accommodation parts of the drawer box including the money case.
Figure 18B:
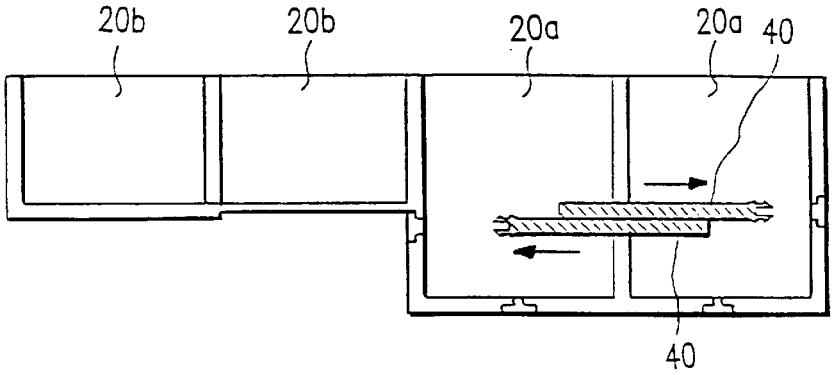
Figure 18C:
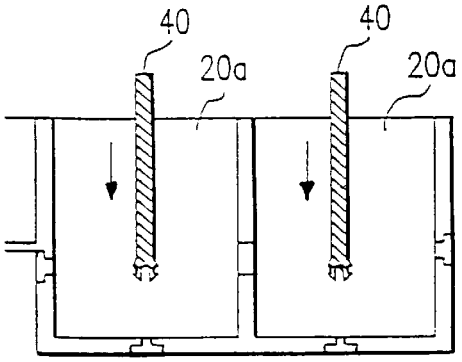
Figure 18D:
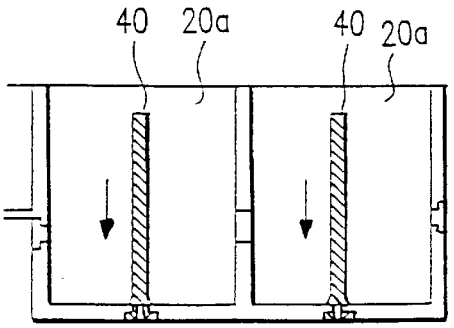

In the case where there are many kinds of notes to be accommodated, the protrusion 45 is disengaged from the engagement portion 28*a*, and the divider 40 is retracted through the slit 29 in a direction of arrow B as shown in FIG. 15B. Then, as shown in FIGS. 15C and 15D, the divider 40 is vertically inserted into the note accommodation part 20*a* with the protrusion 45 facing downward, and the protrusion 45 is fitted into the engagement portion 28*b*. This divides the note accommodation part 20*a* into two side portions having a deep-bottomed shape. In this manner notes can be accommodated vertically. This increases the note accommodation space without increasing the width of the drawer box 180.

Furthermore, since notes can be accommodated vertically in the note accommodation space, the notes can be deposited and retrieved and recognized more easily.

EXAMPLE 10

FIGS. 16A, 16B, 16C and 16D illustrate a drawer box 190 including a money case 390 in Example 10 according to the present invention. Like the drawer box 180 in Example 9, the drawer box 190 adopts the divider rearrangement system for the note accommodation area 20 in the money case 390. The drawer box 190 is different from the drawer box 180 in that the drawer box 190 has two note accommodation parts 20*a* located at both of two ends of a row having the four note accommodation parts arranged in a width direction W of the money case 390. The note accommodation parts 20*a* include the divider 40 and have a deep-bottomed shape. This further provides an additional note accommodation space. The two note accommodation parts 20*b* placed between the note accommodation parts 20*a* have a shallow bottomed shape.

EXAMPLE 11

FIGS. 17A, 17B, 17C and 17D illustrate a drawer box 400 including a money case 600 in Example 11 according to the present invention. Like the drawer boxes 180 and 190 in Examples 9 and 10, the drawer box 400 adopts the divider rearrangement system for the note accommodation area 20 in the money case 600. As in Example 10, two note accommodation parts 20*a* of a deep-bottomed shape including the divider 40 are provided at both of two ends of the row. The drawer box 400 is different from the drawer box 190 in Example 10 in that the lock unit 60 for maintaining the drawer box 400 in an opened or closed state is provided under the two note accommodation parts 20*b* having a shallow-bottomed shape which are sandwiched between the note accommodation parts 20*a*.

By providing the note accommodation parts 20*a* at both of two ends of the row and leaving the note accommodation parts 20*b* shallow-bottomed, the note accommodation space can be increased without sacrificing installment space for the lock unit 60.

The divider 40 can be moved as described above in the state where the money case 600 is taken out of a main body (not shown) of the drawer box 400. The lock unit 60 is attached on the bottom surface of the main body. Accordingly, the divider 40 does not interfere with the lock unit 60 while the divider 40 is being moved. This also applies to a drawer box 410 as in Example 12.

EXAMPLE 12

FIGS. 18A, 18B, 18C and 18D illustrate a drawer box 410 including a money case 610 in Example 12 according to the present invention. Like the drawer boxes 180, 190 and 400 in Examples 9, 10 and 11, the drawer box 410 adopts the divider rearrangement system for the note accommodation area 20 in the money case 610. The note accommodation area 20 of Example 12 is different from those of Examples 9, 10 and 11 in that two of the note accommodation parts 20*a* are located at one end of the row and include the divider 40 and have a deep-bottomed shape. The lock unit 60 is provided under the two note accommodation parts 20*b* which have a shallow-bottomed shape. The note accommodation space can be increased without sacrificing installment space for the lock unit 60.

EXAMPLE 13

Figure 19:
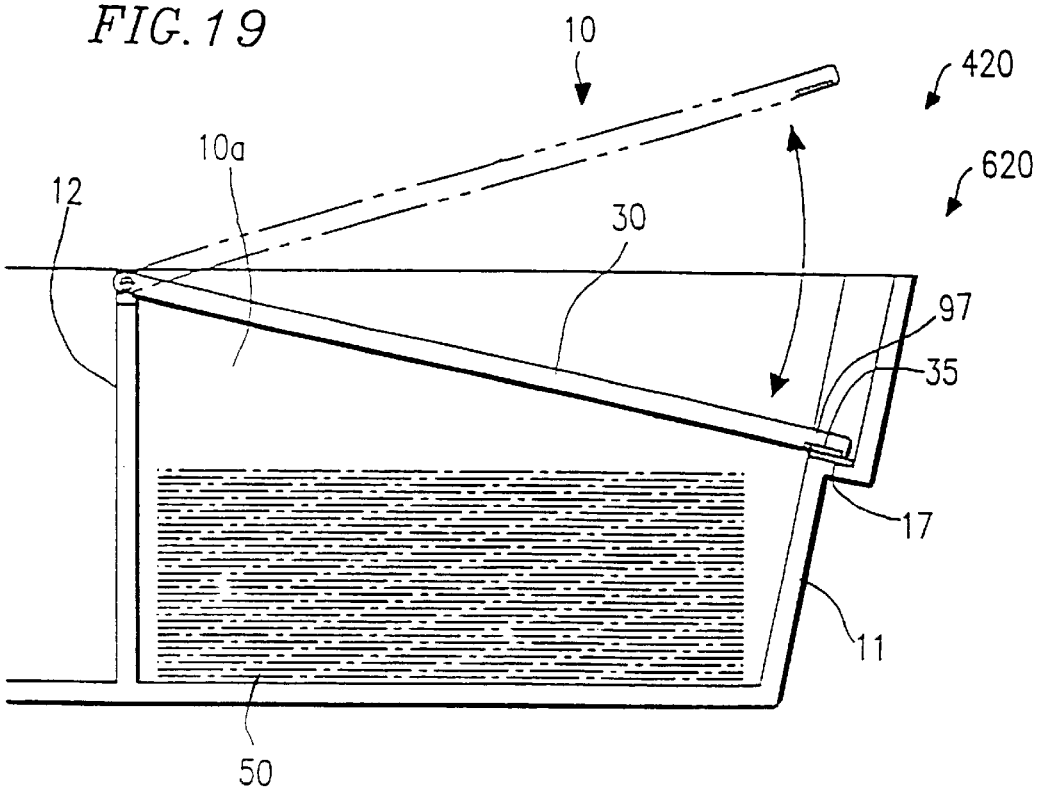
FIG. 19 is a cross-sectional view of a drawer box including a money case in Example 13 according to the present invention, illustrating a method for operating a hinged divider for the coin accommodation part of the drawer box including the money case.
Figure 20:
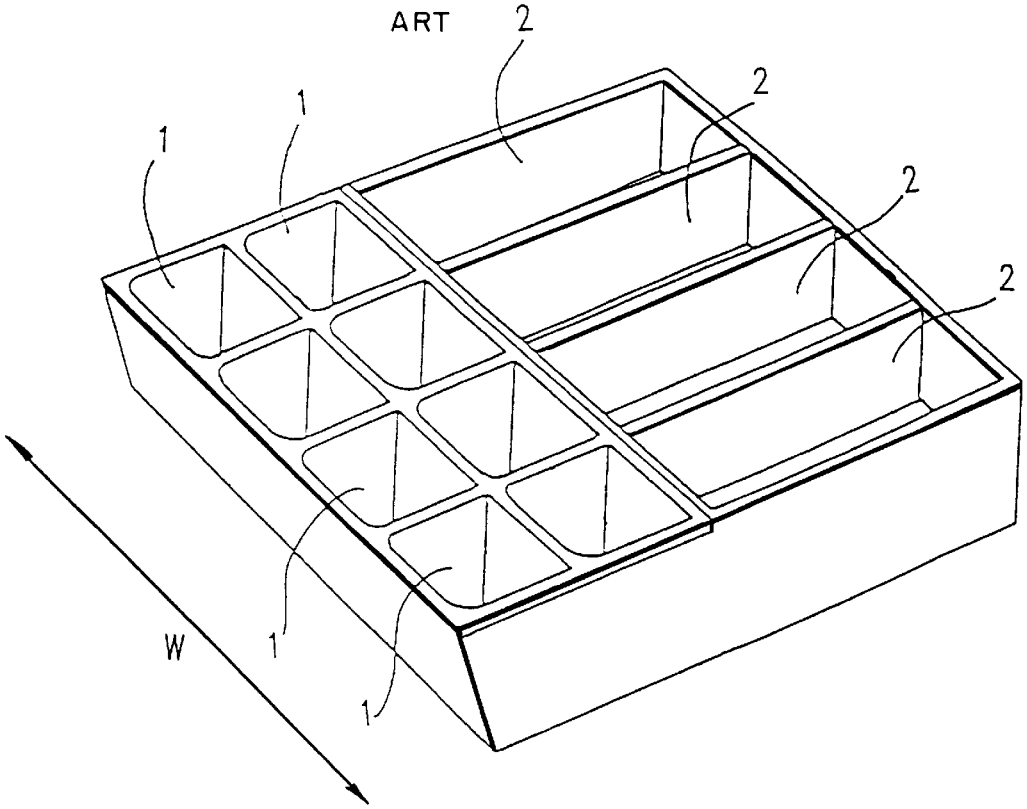
FIG. 20 PRIOR ART
FIG. 20 is a perspective view of a conventional drawer box including a money case.

FIG. 19 illustrates a drawer box 420 including a money case 620 in Example 13 according to the present invention. Like the drawer box 100 in Example 1, the drawer box 420 adopts the divider rearrangement system for the coin accommodation area 10 of a money case. The drawer box 420 of Example 13 adopts a locking device for locking a free end 97 of the divider 30 to the wall 11.

The locking device of Example 13 includes a magnet 35 attached at the free end 97 of the divider 30, and a metal tip 17 attached to the wall 11. The magnet 35 contacts the metal tip 17 when the divider 30 is lowered. In this state, the free end 97 of the divider 30 is locked to the wall 11. Accordingly, the divider 30 functions as a weight for notes 50 accommodated horizontally in the note accommodation part. This prevents the notes 50 from jumping out of the drawer box 420 when the drawer box 420 is opened and closed even though the note accommodation part is created in the front portion of the money case 620.

The functions and advantages of the present invention will be described below with reference to the accompanying drawings illustrating the embodiments of the present invention.

FIGS. 3A, 3B, 3C, 6A, 6B, 6C, 7A, 7B and 7C illustrate drawer boxes 100, 110 and 120 including money cases 300, 310 and 320, respectively with a note accommodation area 20 utilizing a divider lifting and lowering system.

In these drawer boxes, among a plurality of note accommodation parts 20*a* and 20*b* for accommodating notes horizontally in a stacked manner, at least one note accommodation part 20*a* has a deep-bottomed shape having a depth substantially equal to the height of the drawer boxes 100, 110 and 120. When a divider 40 is provided in the note accommodation part 20*a* and is held in such a position as to divide the note accommodation part 20*a* into an upper and a lower portions 201*a* and 201*b*, the upper portion 201*a* functions as a note accommodation part with a shallow bottom, thus enabling the notes to be accommodated horizontally in a stacked manner on the divider 40. Sliding the divider 40 obliquely downward from this position creates a note accommodation part of a deep-bottomed shape above the divider 40, thereby enlarging the note accommodation space without increasing the size of the drawer boxes 100, 110 and 120.

Sliding the divider 40 obliquely downward causes an upright portion 42 extended perpendicularly from one end of a bottom plate 41 of the divider 40 to move and separate the note accommodation part 20*a* into two side portions. Thus, notes can be accommodated vertically on two sides of the divider 40. In other words, lowering the divider 40 changes one note accommodation part with a shallow bottom in which notes are accommodated horizontally, into two note accommodation parts in which notes are accommodated vertically. In the two note accommodation parts, the notes can be easily deposited and retrieved. Furthermore, the types of notes accommodated in the note accommodation parts can be recognized.

FIGS. 9A, 9B, 10A, 10B, 11A, 11B, 12A, 12B, 14A and 14B illustrate drawer boxes 130, 140, 150, 160 and 170 including money cases 330, 340, 350, 360 and 370, respectively with a note accommodation area 20 of a divider pivoting system.

When the divider 40 is held substantially horizontally so as to divide the note accommodation part 20*a* into an upper and a lower portions 201*a* and 201*b*, notes can be accommodated horizontally in a stacked manner on the divider 40. When the divider 40 is pivoted so as to be substantially vertical, the note accommodation part 20*a* is divided into two side portions by the divider 40, and the side portions now function as note accommodation parts in which the notes can be accommodated vertically. Pivoting of the divider 40 changes one note accommodation part in which notes are accommodated horizontally, into two note accommodation parts in which notes are accommodated vertically, thereby enlarging the note accommodation space while avoiding an increase in the size of the drawer boxes 130, 140, 150, 160 and 170. Furthermore, depositing and retrieving the notes and recognition of the notes can be easily performed in the enlarged note accommodation space.

FIGS. 15A, 15B, 15C, 15D, 16A, 16B, 16C, 16D, 17A, 17B, 17C, 17D, 18A, 18B, 18C and 18D illustrate drawer boxes 180, 190, 400 and 410 including money cases 380, 390, 600 and 610, respectively with a note accommodation area 20 which utilizes a divider rearrangement system.

When the divider 40 is held in such a position as to divide the note accommodation part 20*a* into an upper and a lower portion 201*a* and 201*b*, respectively, notes can be accommodated horizontally in a stacked manner on the divider 40. When the divider 40 is held in such a position as to divide the note accommodation part 20*a* into two side portions, the side portions function as note accommodation parts in which the notes can be accommodated vertically. Rearrangement of the divider 40 changes one note accommodation part in which notes are accommodated horizontally, into two note accommodation parts in which the notes are accommodated vertically, thereby enlarging the note accommodation space while avoiding an increase in the size of the drawer boxes 180, 190, 400 and 410. Furthermore, depositing and retrieving the notes and recognition of the notes can be easily performed in the enlarged note accommodation space.

FIGS. 7A, 7B, 7C, 11A, 11B, 12A, 12B, 17A, 17B, 17C, 17D, 18A, 18B, 18C, and 18D illustrate drawer boxes 120, 150, 160, 400 and 410 including money cases 320, 350, 360, 600 and 610, respectively, in which the note accommodation parts 20*a* which have a deep-bottomed shape with the divider 40 are provided at one end or at both ends of the drawer boxes 120, 150, 160, 400 and 410.

In the drawer boxes 120, 150, 160, 400 and 410, the note accommodation parts 20*b* have a shallow-bottomed shape. Thus, a lock unit 60 for maintaining the drawer boxes 120, 150, 160, 400 and 410 in an opened or closed state can be provided under the note accommodation parts 20*b*. Therefore, the note accommodation space can be increased without sacrificing installment space for the lock unit 60.

FIGS. 4A, 4B, 5 and 19 illustrate drawer boxes 100 and 420 including money cases 300 and 620, respectively, with a coin accommodation area 10 utilizing a divider rearrangement system.

In the drawer boxes 100 and 420, a removable divider 30 can be vertically inserted into the coin accommodation part 10*a* and thereby act as a partition between the two coin accommodation parts 10*b*. When the divider 30 is pulled out (when the divider 30 is removed) the notes can be horizontally accommodated in the coin accommodation part 10*a*. This enlarges a note accommodation space while avoiding an increase in the size of the drawer box. Furthermore, depositing and retrieving the notes and recognition of the notes can be easily performed in the enlarged note accommodation space.

Furthermore, the divider 30 can be hinged to a top edge of the wall 12, and a free end of the divider 30 is locked to the wall 11. In this state, the divider 30 functions as a weight for notes accommodated in the newly created note accommodation part. This prevents the notes from jumping out of the drawer boxes 100 and 420 when the drawer boxes 100 and 420 are opened and closed even though the note accommodation part is created in the front portion thereof.

The coin accommodation area 10 of the divider rearrangement system can be combined with the aforementioned note accommodation area 20 of the divider lifting and lowering system, the divider pivoting system, or the divider rearrangement system.

In the above Examples, the numbers of the note accommodation parts and the coin accommodation parts and portions are not limited to the ones mentioned above.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A drawer box, comprising:

a plurality of note accommodation parts arranged in a width direction of the drawer box, at least one note accommodation part being deep-bottomed with a depth substantially equal to a height of the drawer box;

a divider including a bottom plate for dividing the at least one deep-bottomed note accommodation part into an upper portion and a lower portion, the divider further including an upright portion which extends perpendicularly from one end of the bottom plate;

a first holding device for holding the divider in a position where the bottom plate divides the at least one deep-bottomed note accommodation part into the upper portion and the lower portion;

a guide device for guiding the divider to a bottom position, wherein the divider divides the at least one deep-bottomed note accommodation part into two side portions by the upright portion of the divider; and a second holding device for holding the divider in the bottom position.

2. A drawer box according to claim 1, wherein the at least one deep-bottomed note accommodation part including the divider is provided on one side of the drawer box.

3. A drawer box according to claim 2, wherein a note accommodation part other than the at least one deep bottom note accommodation part has a shallow-bottomed shape, and a lock unit is provided under the note accommodation part having the shallow-bottomed shape.

4. A drawer box according to claim 3, wherein the note accommodation part having the shallow-bottomed shape horizontally accommodates notes in a stacked manner.

5. A drawer box according to claim 1, wherein the at least one deep-bottomed note accommodation part including the divider is provided on each of two sides of the drawer box.

6. A drawer box according to claim 1, wherein the guide device obliquely guides the divider to a bottom position, wherein the divider divides the at least one deep-bottomed note accommodation part into two side portions by the upright portion of the divider.

7. A drawer box, comprising:

a plurality of coin accommodation parts provided in the drawer box;

a divider detachably provided in the drawer box dividing at least one of the plurality of coin accommodation parts into at least two coin accommodation portions;

a first holding device detachably holding the divider in a position of dividing the at least one coin accommodation part into at least two coin accommodation portions; and a second holding device pivotally hinging the divider to a top edge of a wall of the at least one coin accommodation part about a horizontal axis.

* * * * *